US012473917B2

(12) United States Patent
Ignatiev et al.

(10) Patent No.: US 12,473,917 B2
(45) Date of Patent: Nov. 18, 2025

(54) SCROLL ASSEMBLIES AND COMPRESSORS INCLUDING THE SAME

(71) Applicant: Copeland LP, Sidney, OH (US)

(72) Inventors: Kirill Michailovich Ignatiev, Oakwood, OH (US); Mikhail A. Antimonov, Beavercreek, OH (US); Robert Christopher Stover, Versailles, OH (US)

(73) Assignee: Copeland LP, Sidney, OH (US)

( * ) Notice: Subject to any disclaimer, the term of this patent is extended or adjusted under 35 U.S.C. 154(b) by 118 days.

(21) Appl. No.: 18/481,802

(22) Filed: Oct. 5, 2023

(65) Prior Publication Data

US 2025/0116272 A1 Apr. 10, 2025

(51) Int. Cl.

| | |
|---|---|
| ***F04C 18/02*** | (2006.01) |
| ***F04C 27/00*** | (2006.01) |
| ***F04C 29/00*** | (2006.01) |

(52) U.S. Cl.

CPC ..... *F04C 18/0215* (2013.01); *F04C 27/001* (2013.01); *F04C 29/0042* (2013.01); *F04C 2240/50* (2013.01)

(58) Field of Classification Search

CPC ..... F04C 18/0215; F04C 27/00–02; F04C 29/0028; F04C 29/0042; F04C 2240/50

See application file for complete search history.

(56) References Cited

U.S. PATENT DOCUMENTS

| | | | |
|---|---|---|---|
| 5,088,906 | A | 2/1992 | Richardson, Jr. |
| RE35,760 | E | 4/1998 | Vaccaro |
| 6,146,118 | A | 11/2000 | Haller et al. |
| 6,719,545 | B2 | 4/2004 | Iizuka |
| 6,758,659 | B2 | 7/2004 | Ni |
| 7,316,550 | B2 | 1/2008 | Kim et al. |
| 7,341,440 | B2 | 3/2008 | Kim et al. |
| 7,837,452 | B2 | 11/2010 | Ignatiev et al. |
| 7,850,438 | B2 | 12/2010 | Sato et al. |

(Continued)

FOREIGN PATENT DOCUMENTS

| | | | |
|---|---|---|---|
| CN | 112343816 | A | 2/2021 |
| DE | 102019200507 | A1 * | 7/2020 |
| EP | 3824186 | B1 | 8/2023 |

OTHER PUBLICATIONS

International Search Report and Written Opinion issued by the International Searching Authority in PCT/US2023/076127 mailed on Jun. 6, 2024, pp. 1-21.

*Primary Examiner* — Loren C Edwards
(74) *Attorney, Agent, or Firm* — Armstrong Teasdale LLP

(57) ABSTRACT

A compressor includes a shell and a main bearing housing positioned within the shell. The main bearing housing includes a scroll assembly positioned within the shell and positioned relative to a first cavity of the main bearing housing, the scroll assembly includes a non-orbiting scroll, an orbiting scroll, and a cylindrical hub, and a coupling positioned between the orbiting scroll and a fixed component and movable relative to at least one of the orbiting scroll and the fixed component. A first seal may be positioned between the orbiting scroll and the coupling, a second seal may be positioned between the coupling and the main bearing housing, and a third seal may be positioned between the cylindrical hub and the main bearing housing, wherein the main bearing housing and the orbiting scroll define a pressure cavity.

20 Claims, 40 Drawing Sheets

Detail 1

(56) References Cited

U.S. PATENT DOCUMENTS

| | | | | |
|---|---|---|---|---|
| 10,495,088 | B2 | 12/2019 | Oh et al. | |
| 11,015,596 | B2 | 5/2021 | Lee et al. | |
| 11,053,938 | B2 | 7/2021 | Kim et al. | |
| 11,105,332 | B2 | 8/2021 | Huang et al. | |
| 2020/0102954 | A1* | 4/2020 | Takashi | F04C 27/005 |
| 2020/0232462 | A1* | 7/2020 | Park | F04C 27/001 |
| 2022/0136501 | A1 | 5/2022 | Yun et al. | |

* cited by examiner

Section A-A

Detail 1

Section C-C

Section B-B

Section D-D

Section A-A

Detail 1

Section C-C

Section B-B

Section D-D

Section A-A

Detail 1

Section C-C

Section B-B

Section D-D

Section A-A

Detail 1

Section C-C

Section B-B

Section D-D

Section E-E

Section E-E

Section F-F

Detail 2

SCROLL ASSEMBLIES AND COMPRESSORS INCLUDING THE SAME

FIELD

The field relates generally to systems and methods for internal sealing of a compressor, and more particularly, to sealing within scroll assemblies for use in compressors.

BACKGROUND

Scroll compressors compress refrigerant using a scroll assembly including a non-orbiting scroll member and an orbiting scroll member that cooperate to form sealed pockets therebetween. During operation of the scroll compressor, motion of the orbiting scroll member relative to the non-orbiting scroll member continuously changes the volume of the sealed pockets to compress refrigerant within.

In a scroll compressor with a floating scroll, axial balancing is often accomplished by dual pressure balancing, which promotes accurate tuning of clamping force to minimize friction losses in the scroll. The floating orbit design with dual pressure balance requires at least two seals to separate suction, intermediate, and discharge pressure gas. However, a challenge occurs between the seal and coupling because they are typically in the same position.

This background section is intended to introduce the reader to various aspects of art that may be related to various aspects of the present disclosure, which are described and/or claimed below. This discussion is believed to be helpful in providing the reader with supporting information to facilitate a better understanding of the various aspects of the present disclosure. Accordingly, it should be understood that these statements are to be read in this light, and not as admissions of prior art.

SUMMARY

In one aspect, a compressor includes a shell and a main bearing housing positioned within the shell. The main bearing housing includes a first cavity and a primary bearing positioned within a second cavity positioned opposite the first cavity. The main bearing housing includes a scroll assembly positioned within the shell and positioned relative to the first cavity of the main bearing housing, the scroll assembly includes a non-orbiting scroll including a non-orbiting spiral wrap, an orbiting scroll including an orbiting spiral wrap and a cylindrical hub oppositely positioned from the orbiting spiral wrap, the cylindrical hub defines a first opening including a drive bearing positioned therein, and a coupling positioned between the orbiting scroll and a fixed component and movable relative to at least one of the orbiting scroll and the fixed component. A drive shaft may be axially positioned relative to the first and second cavities of the main bearing housing, the drive shaft including a driveshaft body and an eccentric body, the eccentric body positioned within the first opening and drivingly engaged with the drive bearing of the orbiting scroll. A first seal positioned between the orbiting scroll and the coupling, a second seal positioned between the coupling and the main bearing housing, and a third seal positioned between the cylindrical hub and the main bearing housing, wherein the main bearing housing and the orbiting scroll define a pressure cavity.

In another aspect, a scroll assembly mounted in a main bearing housing includes a non-orbiting scroll including a non-orbiting spiral wrap, an orbiting scroll including an orbiting spiral wrap and a cylindrical hub oppositely positioned from the orbiting spiral wrap, and a coupling positioned between the orbiting scroll and a fixed component and movable relative to at least one of the orbiting scroll and the fixed component. A first seal may be positioned between the orbiting scroll and the coupling, a second seal may be positioned between the coupling and the main bearing housing, and a third seal may be positioned between the cylindrical hub and the main bearing housing, wherein at least the main bearing housing and the orbiting scroll define a pressure cavity.

In another aspect, a compressor includes a shell, and a main bearing housing positioned within the shell. The main bearing housing includes a first cavity, and a primary bearing positioned within a second cavity positioned opposite the first cavity. A scroll assembly positioned within the shell and positioned relative to the first cavity of the main bearing housing, the scroll assembly includes a non-orbiting scroll including a non-orbiting spiral wrap, an orbiting scroll including an orbiting spiral wrap and a cylindrical hub oppositely positioned from the orbiting spiral wrap, the cylindrical hub defines a first opening including a drive bearing positioned therein, and a coupling positioned between the orbiting scroll and a fixed component and movable relative to at least one of the orbiting scroll and the fixed component; and a drive shaft axially positioned relative to the first and second cavities of the main bearing housing, the drive shaft including a driveshaft body and an eccentric body, the eccentric body positioned within the first opening and drivingly engaged with the drive bearing of the orbiting scroll. A plurality of seals positioned relative to the scroll assembly and the main bearing housing, wherein the plurality of seals isolate a pressure cavity defined by at least the orbiting scroll and the main bearing housing.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
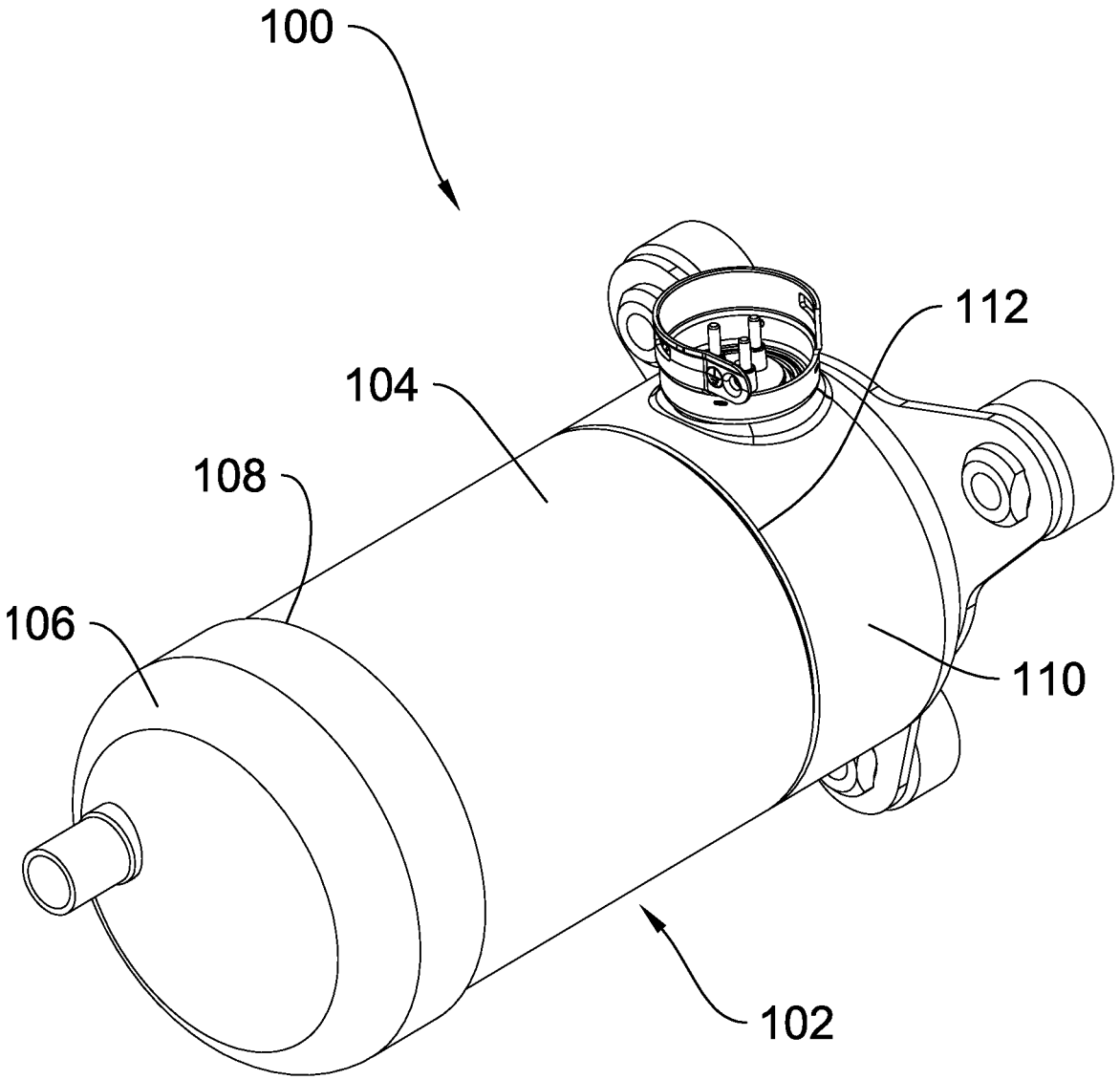
FIG. 1 is a perspective view of a compressor of one embodiment.
Figure 2:
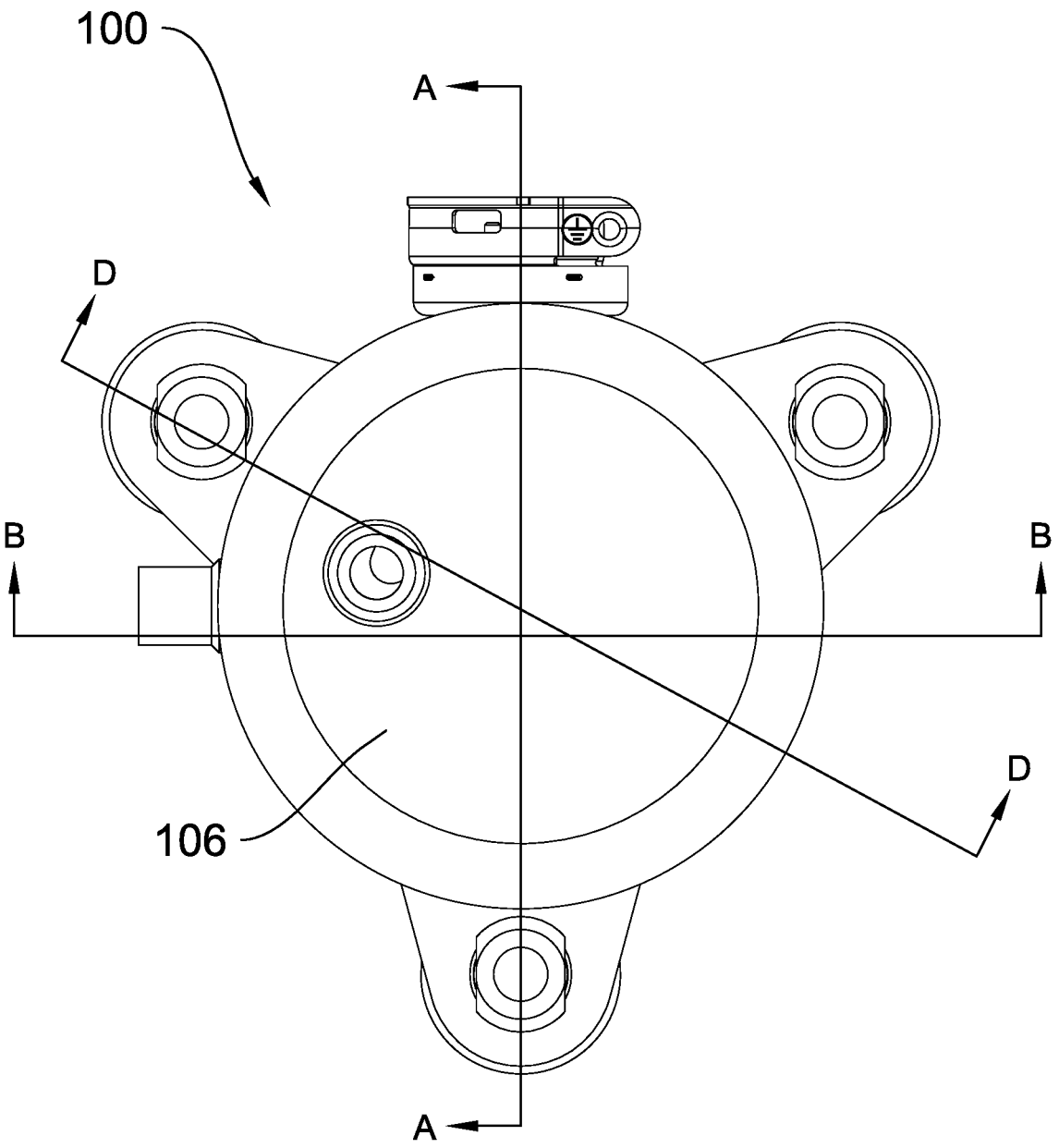
FIG. 2 is a top view of the compressor.

Referring to FIGS. 1 and 2, a compressor, in this example a scroll compressor, is indicated generally at 100. The compressor 100 (e.g., a high-side compressor) includes a compressor housing 102 forming at least one sealed cavity within which refrigerant compression is accomplished. The compressor housing 102 includes a shell 104, an end cap 106 positioned at a first end 108 of the shell 104, and a base 110 positioned at an opposing second end 112 of the shell 104. The scroll compressor 100 may be a floating orbit design, a floating non-orbit design such as co-rotating, and related compressor designs.

Referring now to FIGS. 3-30, the compressor 100 includes a non-orbiting scroll 120 and an orbiting scroll 122 operably engaged with a motor assembly 124. The end cap 106 and the non-orbiting scroll 120 at least partially define a first chamber 128. In some embodiments, at least a portion of the shell 104 and/or a muffler plate (not shown) at least partially defines the first chamber 128. The shell 104 at least partially defines a second chamber 130. The motor assembly 124 includes a motor stator 134 and a rotor 136. The compressor 100 also includes a driveshaft 138 that may be press fit within the rotor 136. The rotor 136 transmits rotational power to the driveshaft 138. The motor assembly 124 may be a variable-speed motor for rotating the driveshaft 138 at any of a plurality of speeds. In the illustrated embodiment, the motor assembly 124 is positioned within the shell 104, e.g., within the second chamber 130. In some other embodiments, the compressor 100 may be an open drive compressor driven by a motor assembly that is positioned outside of the compressor housing 102. The compressor 100 further includes a first bearing assembly 140 and a second bearing assembly 142 that may rotationally support the driveshaft 138.

The driveshaft body 160 includes a longitudinal axis A1. An axial direction includes a direction aligned with, and/or parallel to, the longitudinal axis A1. A radial direction includes a direction that is radial relative to the longitudinal axis A1 and perpendicular to the longitudinal axis A1. The driveshaft 138 includes a driveshaft body 160 and an eccentric body 162 that may be offset from the driveshaft body 160. The driveshaft body 160 and the eccentric body 162 are cylindrical in shape. The eccentric body 162 includes a longitudinal axis A2 that is off set from the longitudinal axis A1. See FIGS. 9, 16, 23, and 30. The driveshaft body 160 includes a first end portion 206 and second end portion 208 rotatably supported by the first and second bearing assemblies 140, 142 respectively. The eccentric body 162 may extend from the first end portion 206.

The orbiting scroll 122 may include an endplate 144 having a spiral wrap 146 extending from a first side 148. The orbiting scroll 122 may further include a cylindrical hub 154 that projects downwardly from the endplate 144 in the direction of a second side 152 of the main bearing housing 180, the cylindrical hub 154 defines an annular flat surface 150. The annular flat surface 150 may interface with the first bearing assembly 140, as will be subsequently described. The eccentric body 162 of the driveshaft 138 may be drivingly engaged to a drive bearing 164. The drive bearing 164 transmits rotational motion from the eccentric body 162 to the orbiting scroll 122. The drive bearing 164 may be positioned within the cylindrical hub 154 of the orbiting scroll 122. A coupling (discussed below), such as an Oldham coupling, may be engaged with the orbiting scroll 122 and the non-orbiting scroll 120, or the main bearing housing 180, to prevent relative rotation therebetween. At least a portion of the main bearing housing 180 may partially define a boundary between the chamber 128 and the chamber 130.

The non-orbiting scroll 120 may include an end plate 170 and a spiral wrap 172 projecting downwardly from the end plate 170. The spiral wrap 172 may engage with the spiral wrap 146 of the orbiting scroll 122, e.g., by meshing engagement of the wraps with one another, thereby creating a series of moving fluid pockets. The fluid pockets defined by the spiral wraps 146, 172 may decrease in volume as they move from a radially outer position (e.g., at a suction pressure) to a radially inner position (e.g., at a discharge pressure that is higher than the suction pressure) throughout a compression cycle. The end plate 170 may include a discharge passage 156, that is in communication with at least one of the fluid pockets at the radially inner position and allows compressed working fluid, such as refrigerant or a mixture of refrigerant and lubricant, (at or near the discharge pressure) to flow therethrough and into the chamber 128.

An inlet 175 is attached to the compressor housing 102 in the end cap 106, for drawing the working fluid into the fluid pockets defined by the spiral wrap 172 and the spiral wrap 146, where the working fluid is compressed. After the working fluid is compressed, the compressed working fluid exits the fluid pocket defined by the spiral wrap 172 and the spiral wrap 146 through the discharge passage 156 and into chamber 128. The compressed working fluid flows from the chamber 128 into chamber 130 through one or more passages between the non-orbiting and orbiting scrolls 120, 122, and the shell 104. The compressed working fluid exits the chamber 130 through a discharge fitting 176. The discharge fitting 176 may be attached to the base 110 of the compressor housing 102. A discharge valve assembly, not shown, may be positioned within the discharge fitting 176 and may generally prevent a reverse flow condition through the discharge fitting 176. A hermetic terminal 178 may be attached to the compressor housing 102 at the base 110.

The compressor 100 includes a main bearing housing 180 that may be fixed relative to the compressor housing 102. For example, the main bearing housing 180 may be inserted (e.g., pressed) into the shell 104 of the compressor housing 102. The non-orbiting scroll 120 may be connected to the main bearing housing 180. The main bearing housing 180 includes a cylindrical hub 182 defining a cavity 184 that is sized and shaped to receive the first bearing assembly 140 therein. The main bearing housing 180 and first bearing assembly 140 may cooperate to support the driveshaft 138 for rotational motion relative thereto. In alternative embodiments, the main bearing housing 180 may axially support the orbiting scroll 122 for orbital motion relative thereto.

The first bearing assembly 140 is a ball bearing including an outer ring 190, an inner ring 192 and a plurality of balls 200 positioned between the outer ring 190 and the inner ring 192. In other embodiments, the first bearing assembly 140 may include other types of rolling bearings, and/or sleeve/journal bearings. The inner ring 192 includes an inner surface (not shown) defining a bearing opening (not shown). The driveshaft body 160 is positioned within the bearing opening.

A first counterweight 220 and a second counterweight 222 may be attached to the driveshaft body 160 between the first and second bearing assemblies 140, 142 to rotationally balance the driveshaft 138. The first and second counterweights 220, 222 may be configured and positioned such that an inertial force of the first counterweight 220 may counteract or balance a sum of inertial forces of the second counterweight 222, the orbiting scroll 122, drive bearing 164, and the eccentric body 162. In other embodiments, alternative moving eccentric components may be used in replacement of or in addition to the first counterweight 220, the second counterweight 222 or both the first and second counterweights 220, 222. In some instances, various seals and snap-rings may be balanced.

The example compressor 100 includes a coupling, such as an Oldham coupling, positioned between the orbiting scroll 122 and a fixed component (e.g., the non-orbiting scroll 120, the main bearing housing 180). The Oldham coupling 302 (or 402, 502, 602, 702, 802, hereinafter just 302 for ease of reference) is configured to prohibit relative rotation between the orbiting scroll 122 and the non-orbiting scroll or the main bearing housing 180. The Oldham coupling 302 may be constrained between the orbiting scroll 122 and the fixed component, either directly or indirectly. In some instances, Oldham coupling 302 may be movably coupled (e.g., keyed) with the orbiting scroll 122 and/or the fixed component such that the Oldham coupling 302 moves in a first direction (e.g., up) and in a second direction (e.g., down) relative to the orbiting scroll 122 and/or the fixed component. The Oldham coupling 302 may also move radially with respect to the orbiting scroll 122 and/or main bearing housing 180. In some instances, the Oldham coupling 302 may be movably coupled (e.g., keyed) with the orbiting scroll 122 and/or the fixed component such that the Oldham coupling 302 moves in a first direction (e.g., up) and in a second direction (e.g., down) relative to the orbiting scroll 122 and/or the fixed component and moves radially with respect to the orbiting scroll 122 and/or the main bearing housing 180. In some instances, the coupling 302 may be at least partially balanced by one or more alternative moving eccentric components. The coupling 302 is positioned to seal one or more pressure cavities associated with the orbiting scroll 122 and the fixed component. Example sealing details and arrangements are discussed in more detail below with respect to the various embodiments and figures.

As described below and as shown in the figures, the Oldham coupling 302, orbiting scroll 122 and main bearing housing 180 may include various sealing configurations. In non-limiting examples, the various sealing configurations generally define pressure cavities, create a compact compressor system, provide flexibility in creating and optimizing an axial balancing scheme, and combinations thereof. Thus, like parts/features will be numbered the same throughout the various embodiments. Discussion of features with respect to one embodiment may apply to the other embodiments unless expressly stated or the context dictates otherwise.

The endplate 144 of the orbiting scroll 122, the main bearing housing 180, and the coupling 302 together at least partially define an intermediate pressure cavity 196, as shown in the figures, for example, FIGS. 4, 11, 18, and 25. In other embodiments however, the endplate 144 of the orbiting scroll 122, the main bearing housing 180, and the coupling 302 may at least partially define an outside pressure cavity 194. In some embodiments, the endplate 144 of the orbiting scroll 122, the main bearing housing 180, and the coupling 302 may at least partially define the outside pressure cavity 194, and the intermediate pressure cavity 196. Referring to embodiments 1-6, the intermediate pressure cavity 196 and/or the outside pressure cavity 194 are in fluid communication with at least one of the series of moving fluid pockets created by the spiral wraps 146, 172 of the orbiting scroll 122 and non-orbiting scroll 120. The endplate 144 of the orbiting scroll 122 defines a port 198 that fluidly communicates between the series of moving fluid pockets and the intermediate pressure cavity 196, the series of moving fluid pockets and the outside pressure cavity 194, or the series of moving fluid pockets and the intermediate pressure cavity 196 and the outside pressure cavity 194. The pressure cavities 194, 196 may be discharge pressure (e.g., high side), may be intermediate pressure and/or may be suction pressure (e.g., low side) depending on the compressor 100 design (e.g., location of the port 198) and/or based on providing optimized axial balancing (e.g., gas clamping force). In some instances, at least two ports 198 may fluidly communicate with pressure cavities 194, 196.

One or more seals may be mounted with respect to and/or in close proximity to coupling 302. The one or more seals may be configured to seal the intermediate pressure cavity 196, the outside pressure cavity 194, or intermediate pressure cavity 196 and the outside pressure cavity 194. For example, adding one or more seals mounted with respect to and/or in close proximity to coupling 302 may seal the pressure cavities brought about by gas at discharge pressure flowing in the cavity circumferential to coupling 302. The combined one or more seals and coupling 302 may be used to minimize the compression mechanism diameter and to optimize the gas clamping force. The size of the compression mechanism diameter may be predefined and may at least partially dictate the size of the compressor 100 and the gas clamping forces.

Seals (e.g., at least two seals) are suitably mounted on or in close proximity to coupling 302. The location of the seal may be selected from the locations including, but not limited to, endplate 144 of orbiting scroll 122, cylindrical hub 154 of orbiting scroll 122, coupling 302, main bearing housing 180, and combinations thereof. The seals may define a cross-section that is circular, quadrilateral, elliptical, triangular, and combinations thereof. One or more of the seals may include a double seal, for example, including two or more seals in a seal location. The double seal may define seals having the same or different cross-sectional shapes.

In a first embodiment, referring to FIGS. 3-9, compressor 100 includes Oldham coupling 302 positioned at least partially between orbiting scroll 122 and main bearing housing 180. Coupling 302 defines a top surface 304, a bottom surface 306, and a longitudinal axis A3 extending therebetween. The top surface 304 of coupling 302 is positioned at least in close proximity to endplate 144 of orbiting scroll 122 and bottom surface 306 of coupling 302 is positioned at least in close proximity to main bearing housing 180. The top surface 304 of coupling 302 is positioned at least in partial contact with endplate 144 of orbiting scroll 122, either directly or indirectly, and bottom surface 306 of coupling 302 is positioned at least in partial contact with main bearing housing 180, either directly or indirectly.

Compressor 100 includes a first seal 308 mounted with respect to endplate 144 of orbiting scroll 122. First seal 308 is mounted with respect to the endplate 144 and positioned to extend in a direction of coupling 302. First seal 308 is mounted with respect to the endplate 144 such that first seal 308 is in direct or indirect contact with coupling 302. First seal 308 may be positioned within a channel 308' such that a surface of the seal is configured to contact top surface 304 of coupling 302. The depth of the channel 308' may depend, in part, on the thickness of the first seal 308. The amount that first seal 308 protrudes from endplate 144 in the direction of coupling 302 may depend, in part, on at least one of the following, the thickness of first seal 308, the gap between coupling 302 and endplate 144, the depth of the channel 308', and combinations thereof. The channel 308' may extend axially relative to longitudinal axis A3 of coupling 302.

The compressor 100 includes a second seal 310 mounted with respect to coupling 302. Second seal 310 is mounted with respect to the bottom surface 306 of coupling 302. The second seal 310 is mounted with respect to the bottom surface 306 of coupling 302 such that the second seal 310 is in direct or indirect contact with main bearing housing 180. The second seal 310 may be positioned within a channel 310' such that a surface of the seal is configured to contact main bearing housing 180. The depth of the channel 310' may depend, in part, on the thickness of second seal 310. The amount that second seal 310 protrudes from coupling 302 in the direction of main bearing housing 180 may depend, in part, on at least one of the following, the thickness of second seal 310, the gap between coupling 302 and main bearing housing 180, the depth of the channel 310', and combinations thereof. The channel 310' may extend axially relative to longitudinal axis A3 of coupling 302.

Figure 5:
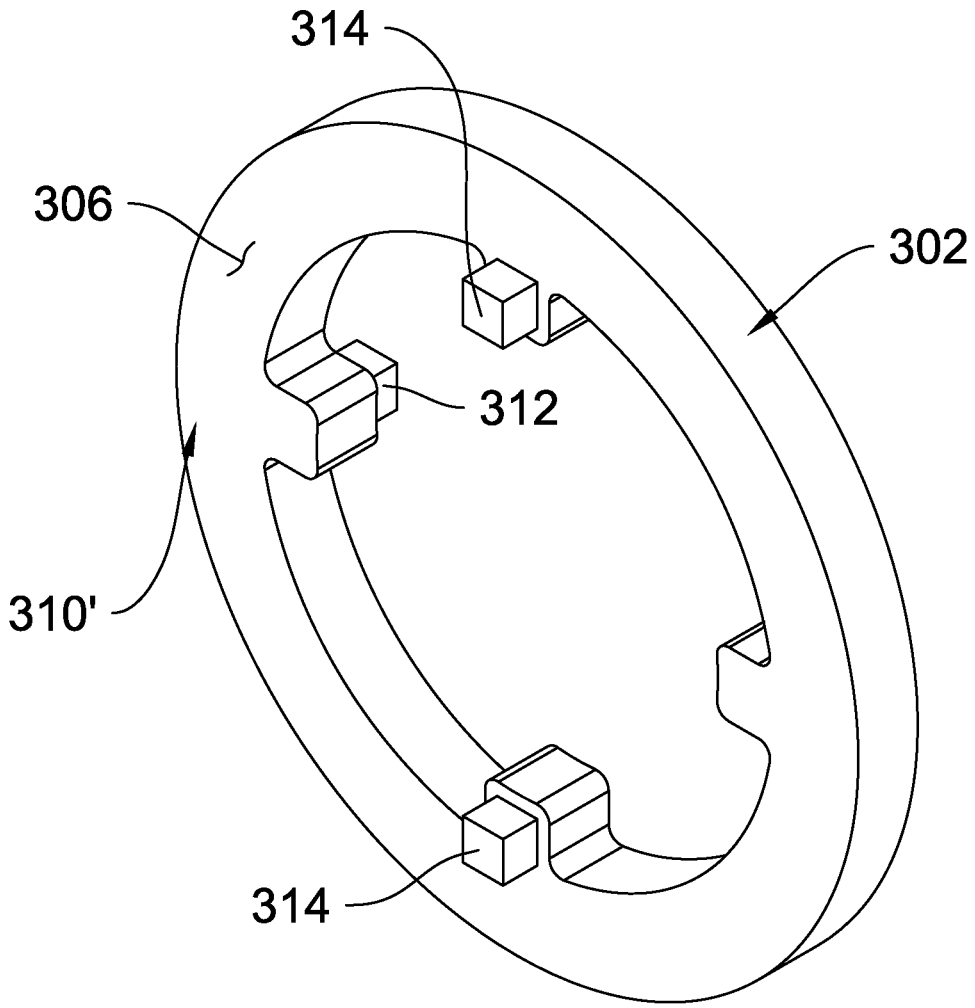
FIG. 5 is a bottom perspective view of an Oldham coupling of the compressor shown in FIGS. 3 and 4.
Figure 6:
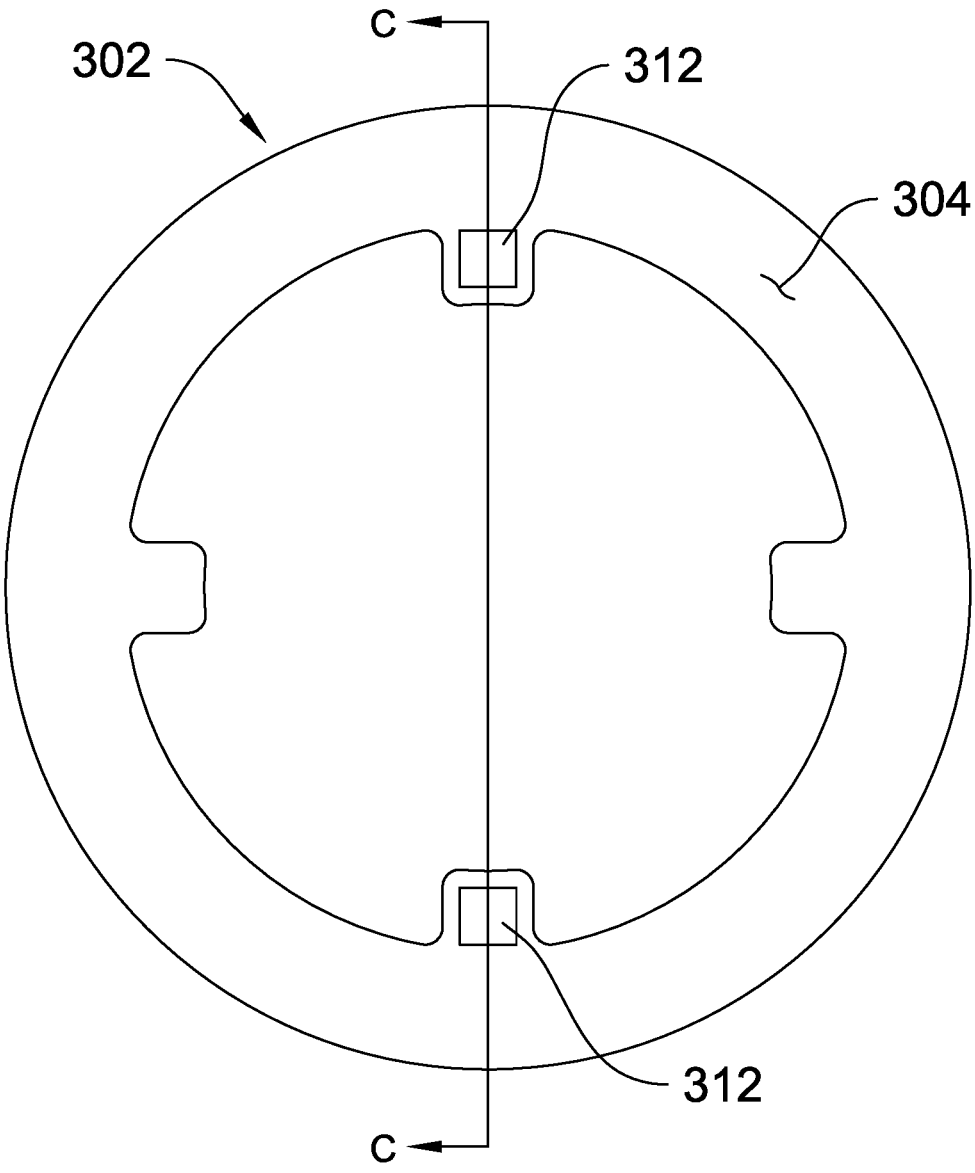
FIG. 6 is a top view of the Oldham coupling shown in FIG. 5.
Figure 7:
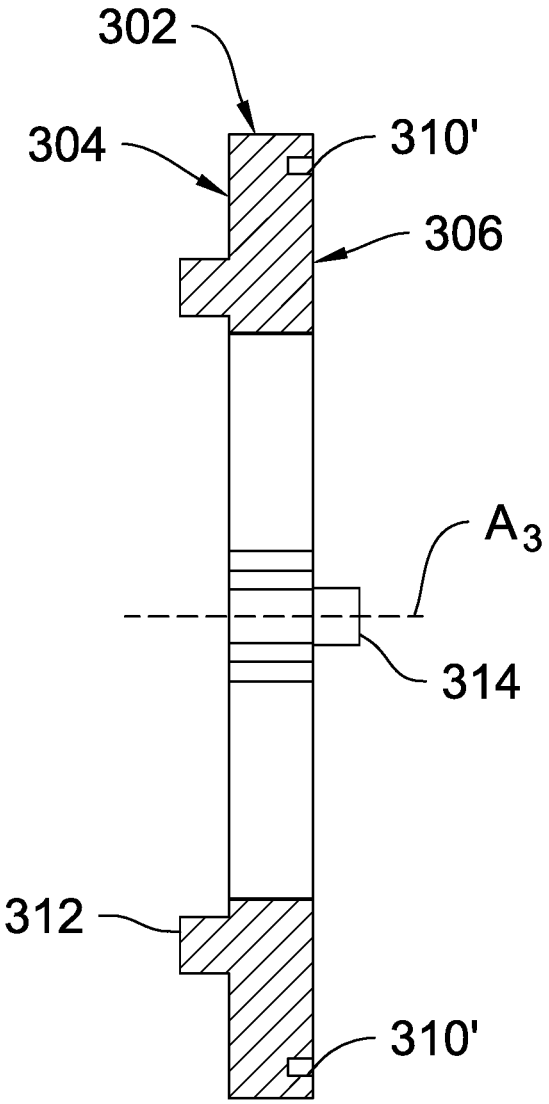
FIG. 7 is a cross-sectional view of the Oldham coupling shown in FIG. 6 taken along line C-C.
Figure 8:
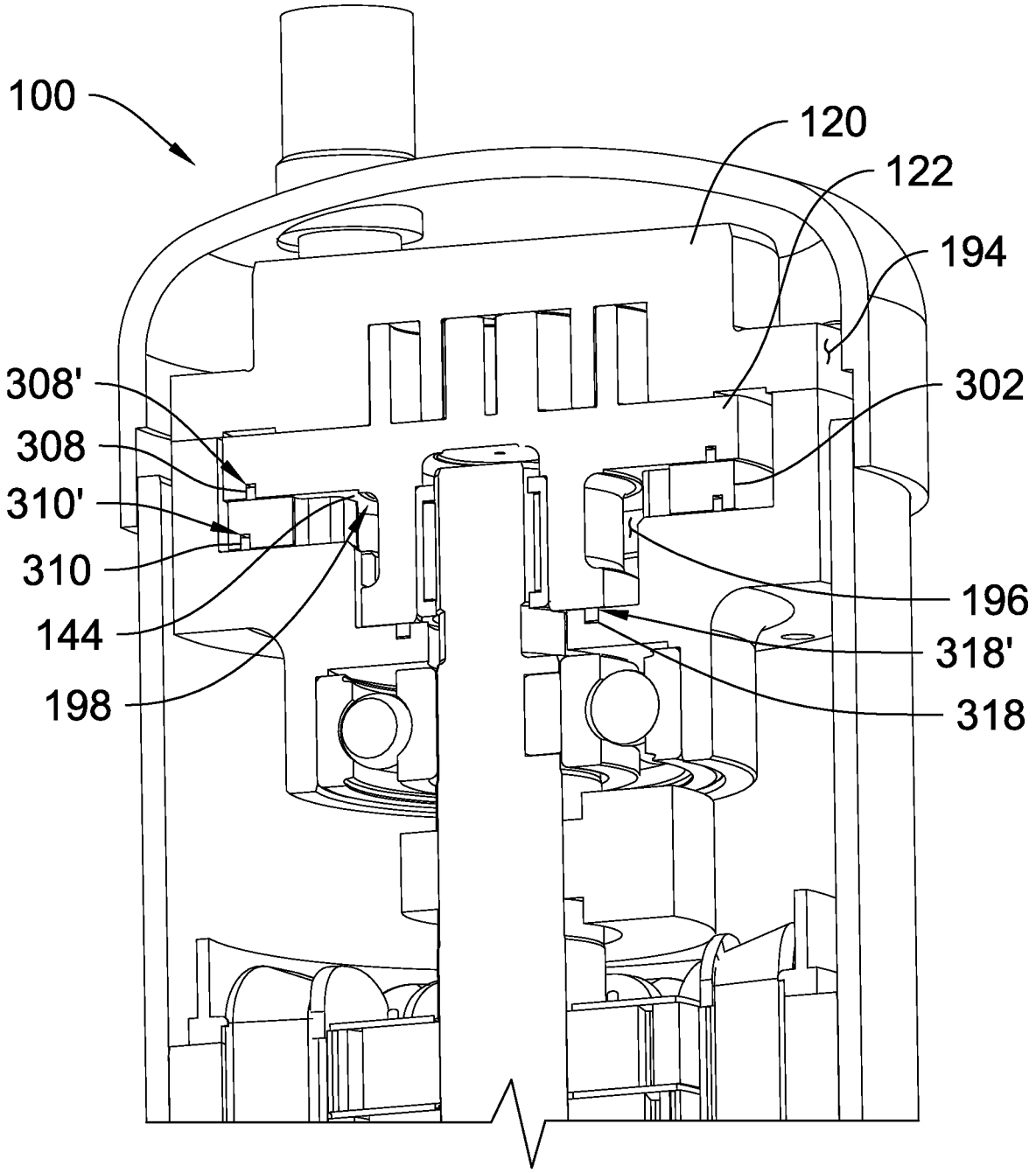
FIG. 8 is a cross-sectional perspective view of the compressor shown in FIGS. 1 and 2 taken along line B-B, illustrating a first seal configuration of the compressor.
Figure 9:
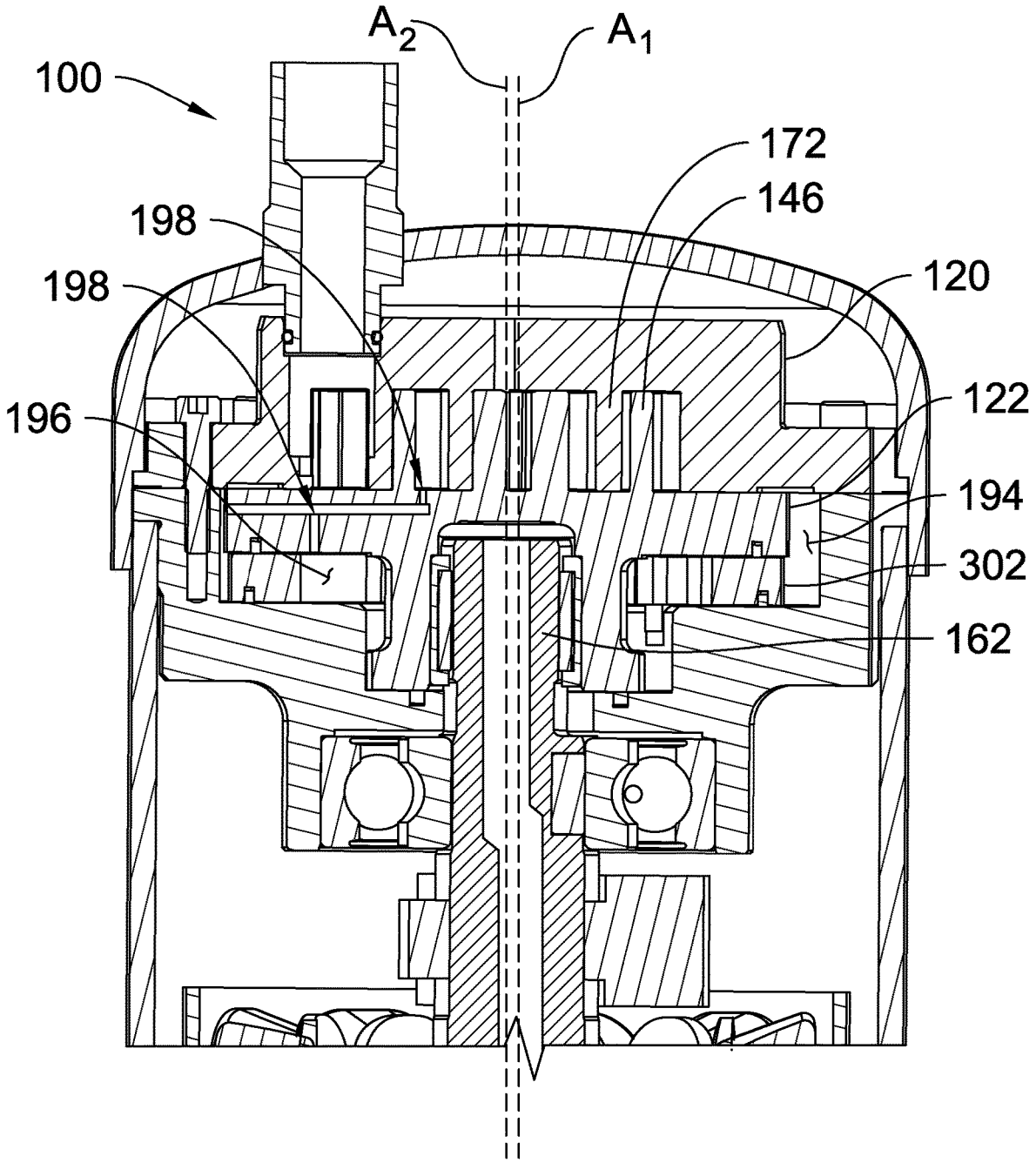
FIG. 9 is a cross-sectional view of the compressor shown in FIGS. 1 and 2 taken along line D-D, illustrating a first seal configuration of the compressor.

Referring to FIGS. 5-7, top surface 304 of coupling 302 is substantially planar and does not include a channel. The bottom surface 306 of coupling 302 is oppositely positioned from the top surface 304 and includes the channel 310', which is configured to receive at least a portion of second seal 310. Coupling 302 includes a top protrusion 312 and a bottom protrusion 314, the top and bottom protrusions 312, 314 are configured to engage with the orbiting scroll 122 and/or the main bearing housing 180, either directly or indirectly. As depicted, the coupling 302 includes two top protrusions 312 and two bottom protrusions 314. The top protrusion 312 extends outwardly from the top surface 304 of the coupling 302 in a direction opposite the bottom surface 306. The top protrusion 312 is configured to movably engage with a protrusion channel 316 of orbiting scroll 122. The bottom protrusion 314 extends outwardly from the bottom surface 306 of the coupling 302 in a direction opposite the top surface 304. The bottom protrusion 314 is positioned and shaped to movably engage with a protrusion channel (not shown) of the main bearing housing 180. The top and bottom protrusions 312, 314 may extend perpendicularly from top surface 304 and bottom surface 306, respectively.

Figure 3:
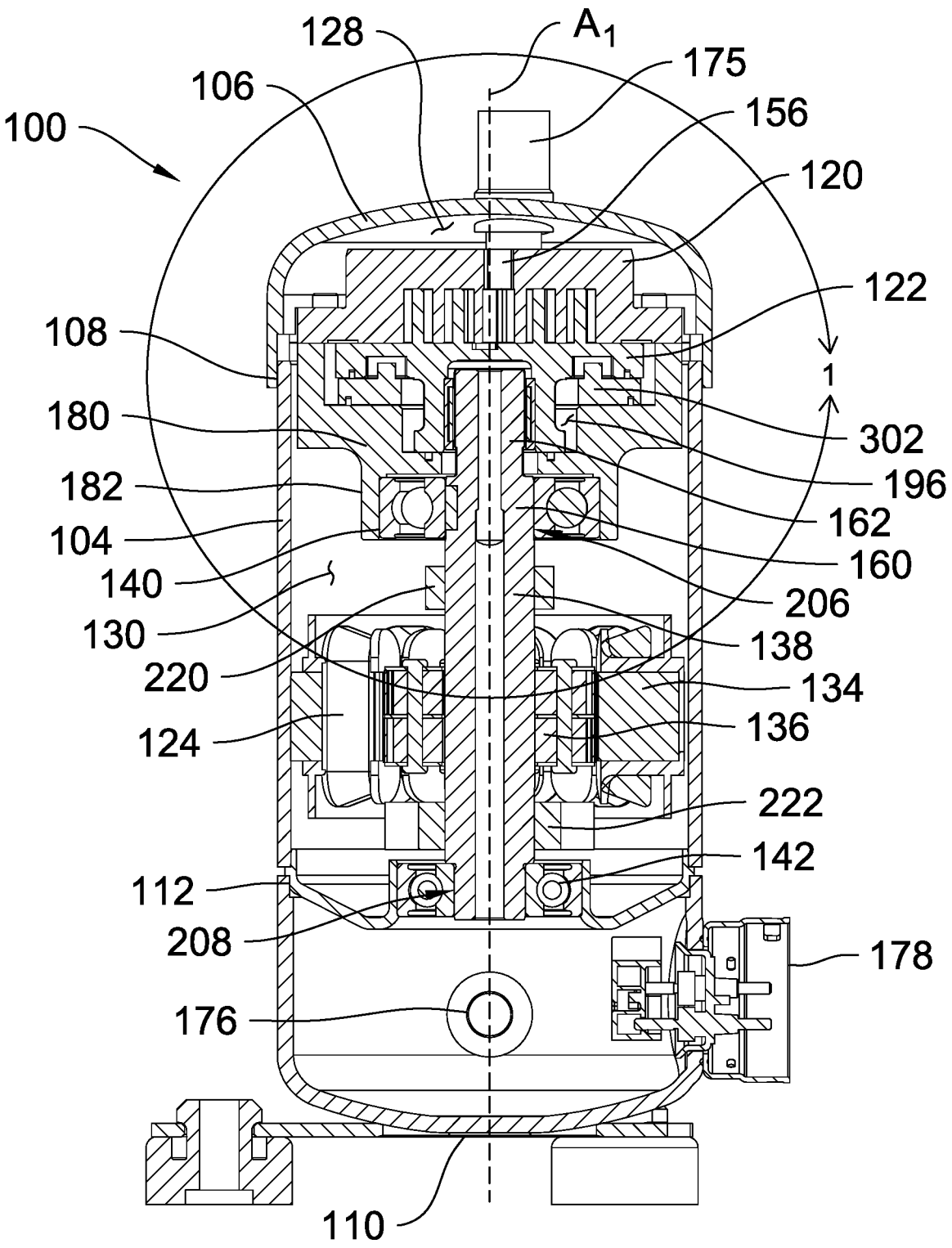
FIG. 3 is a cross-sectional view of the compressor shown in FIGS. 1 and 2 taken along line A-A, illustrating a first seal configuration of the compressor.
Figure 4:
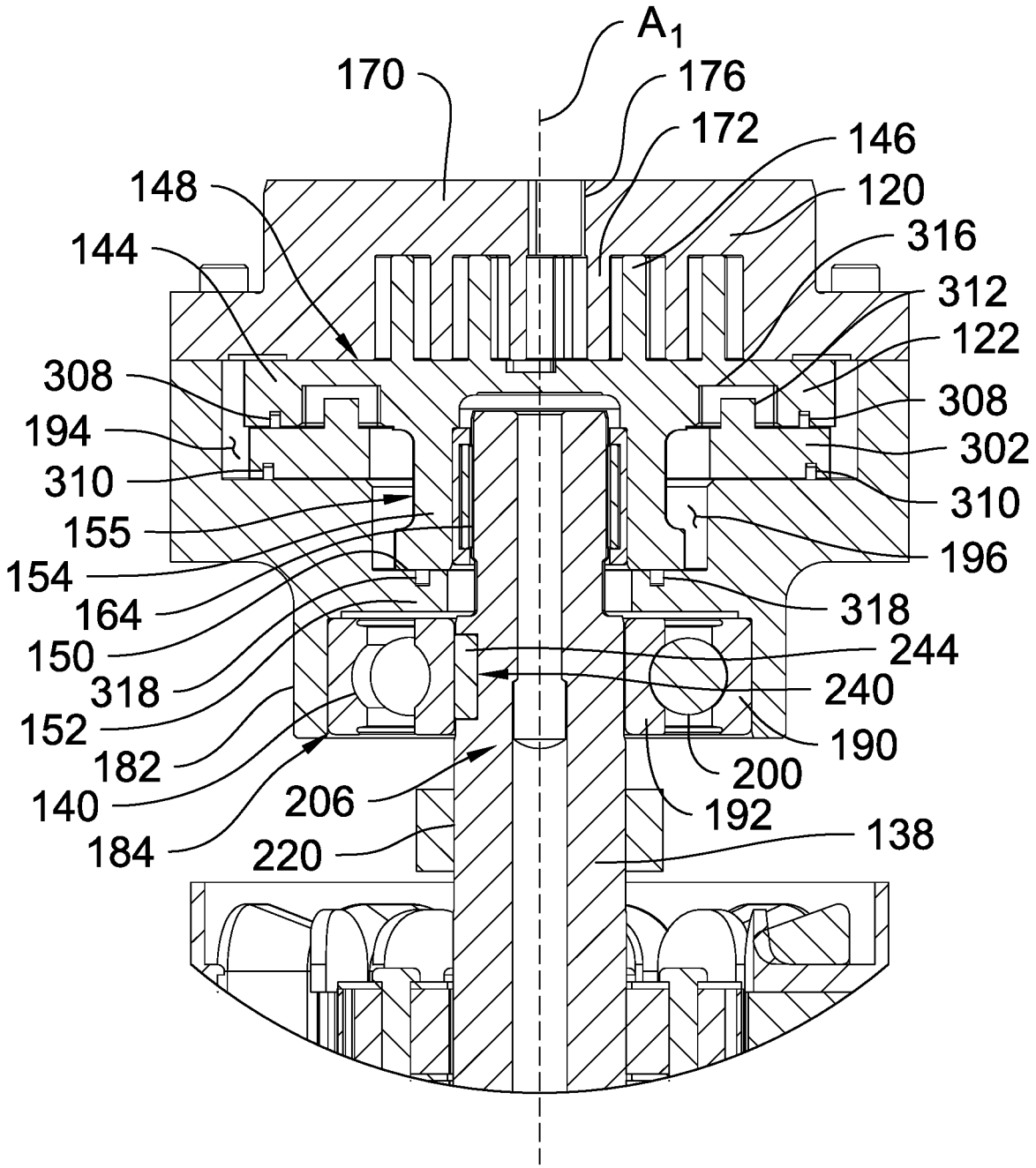
FIG. 4 is a detailed view of the compressor shown in FIG. 3 taken within detail 1, with an endcap and shell removed from the compressor.

Referring to FIGS. 3 and 4, the top protrusion 312 of the coupling 302 is positioned within the protrusion channel 316 of orbiting scroll 122 such that the top protrusion 312 is configured to translate relative to the protrusion channel 316 of the orbiting scroll 122. Similarly, the bottom protrusion 314 of the coupling 302 is positioned within the protrusion channel (not shown) of main bearing housing 180 such that the bottom protrusion 314 is configured to translate relative to the protrusion channel (not shown) of the main bearing housing 180. As depicted in FIGS. 5-7, the top protrusions 312 are oppositely spaced extending from the top surface 304 and the bottom protrusions 314 are oppositely spaced extending from the bottom surface 306. The top protrusions 312 may be spaced about 180 degrees from each other and the bottom protrusions 314 may be spaced about 180 degrees from each other. Thus, one of the top protrusion 312 or the bottom protrusion 314 may be circumferentially spaced about every 90 degrees around longitudinal axis A3 of coupling 302. However, it should be understood that more or less protrusions 312, 314 may be used and may be spaced differently, without departing from the spirit/scope of this disclosure. In operation, coupling 302 may translate relative to orbiting scroll 122 and main bearing housing 180 to ensure the orbiting scroll 122 and the main bearing housing 180 remain indirectly connected during movement. The motion of the orbiting scroll 122 is translational despite moving in two directions. For example, with the Z-axis being parallel to A1, the orbiting scroll 122 moves in the X and Y axis. The top protrusion 312 of the coupling 302 translates within the protrusion channel 316 of the orbiting scroll 122 to enable the coupling 302 to move along the X and Y axes. The bottom protrusion 314 of the coupling 302 translates within the protrusion channel (not shown) of the main bearing housing 180 to enable the coupling 302 to move along the X and Y axes.

As will be discussed in more detail below with respect to FIGS. 31-38, seals 308, 310 may be axially aligned with each other and circumferentially aligned such that the outer portion of each seal 308, 310 is aligned with the other 310, 308. In other instances, seals 308, 310 may be axially aligned but may not be circumferentially aligned. In yet another instance, seals 308, 310 may not be axially aligned. Seals 308, 310 may be aligned axially relative to longitudinal axis A3.

The compressor 100 may also include a hub seal 318 positioned in contact with the cylindrical hub 154 of the orbiting scroll 122. The hub seal 318 is mounted with respect to the second side 152 of the main bearing housing 180. The hub seal 318 is mounted with respect to the second side 152 of the main bearing housing 180 such that the hub seal 318 is in direct or indirect contact with the cylindrical hub 154 of the orbiting scroll 122. The hub seal 318 may be positioned within a channel 318' such that a surface of the hub seal 318 is configured to contact the annular flat surface 150 of the cylindrical hub 154. The depth of the channel 318' may depend, in part, on the thickness of the hub seal 318. The amount that the hub seal 318 protrudes from the main bearing housing 180 in the direction of the cylindrical hub 154 may depend, in part, on at least one of the following, the thickness of the hub seal 318, the gap between the cylindrical hub 182 and the main bearing housing 180, the depth of the channel 318', and combinations thereof. Alternatively, the hub seal 318 may be positioned within the channel 318' and extending outwardly from the annular flat surface 150 of the cylindrical hub 154 in the direction of the second side 152 of the main bearing housing 180.

In operation, pressure produced by the series of moving fluid pockets created by the spiral wraps 146, 172 of the orbiting scroll 122 and non-orbiting scroll 120, is released into the port 198. The port 198 is in fluid communication with the intermediate pressure cavity 196, the outside pressure cavity 194, or the intermediate pressure cavity 196 and the outside pressure cavity 194. In some instances, a second port (not shown) may be in fluid communication with the outside cavity 194. The pressure within the intermediate pressure cavity 196 may be different than the pressure within the outside pressure cavity 194. Each cavity 194, 196 is sealed with two or more seals positioned in direct or indirect contact with the main bearing housing 180, the orbiting scroll 122, and/or the coupling 302. For example, compressed gas discharged into outside pressure cavity 194 may be sealed with the first seal 308 and the second seal 310. Additionally, gas discharged into the outside pressure cavity 194 may be sealed with the first seal 308, the second seal 310, and on a thrust surface (not shown) between the orbiting scroll 122 and the non-orbiting scroll 120. Gas discharged into intermediate pressure cavity 196 may be sealed with the first seal 308, the second seal 310, and the hub seal 318. Sealing of the pressure cavities 194, 196 prevents at least pressure loss which provides pressure to bias the scrolls against one another to reduce efficiency losses due to leakage between the scroll wraps and minimize the friction losses in the compression mechanism.

In a second embodiment, referring to FIGS. 10-16, compressor 100 includes Oldham coupling 402 positioned at least partially between orbiting scroll 122 and main bearing housing 180. Coupling 402 defines a top surface 404, a bottom surface 406, and a longitudinal axis A3 extending therebetween. The top surface 404 of coupling 402 is positioned at least in close proximity to endplate 144 of orbiting scroll 122 and bottom surface 406 of coupling 402 is positioned at least in close proximity to main bearing housing 180. The top surface 404 of coupling 402 is positioned at least in partial contact with endplate 144 of orbiting scroll 122, either directly or indirectly, and bottom surface 406 of coupling 402 is positioned at least in partial contact with main bearing housing 180, either directly or indirectly.

Compressor 100 includes a first seal 408 mounted with respect to the top surface 404 of the coupling 402. First seal 408 is mounted with respect to the top surface 404 of the coupling 402 and positioned to extend in a direction of the orbiting scroll 122. First seal 408 is mounted with respect to the top surface 404 of the coupling 402 such that first seal 408 is in direct or indirect contact with the endplate 144 of orbiting scroll 122. First seal 408 may be positioned within a channel 408' such that a surface of the seal is configured to contact the endplate 144 of the orbiting scroll 122. The depth of the channel 408' may depend, in part, on the thickness of the first seal 408. The amount that first seal 408 protrudes from the top surface 404 of the coupling 402 in the direction of the endplate 144 of the orbiting scroll 122 may depend, in part, on at least one of the following, the thickness of first seal 408, the gap between coupling 402 and endplate 144, the depth of the channel 408', and combinations thereof. The channel 408' may extend axially relative to longitudinal axis A3 of coupling 402.

The compressor 100 includes a second seal 410 mounted with respect to coupling 402. Second seal 410 is mounted with respect to the bottom surface 406 of coupling 402. The second seal 410 is mounted with respect to the bottom surface 406 of coupling 402 such that the second seal 410 is in direct or indirect contact with main bearing housing 180.

The second seal 410 may be positioned within a channel 410' such that a surface of the seal is configured to contact main bearing housing 180. The depth of the channel 410' may depend, in part, on the thickness of second seal 410. The amount that second seal 410 protrudes from coupling 402 in the direction of main bearing housing 180 may depend, in part, on at least one of the following, the thickness of second seal 410, the gap between coupling 402 and main bearing housing 180, the depth of the channel 410', and combinations thereof. The channel 410' may extend axially relative to longitudinal axis A3 of coupling 402.

Figure 12:
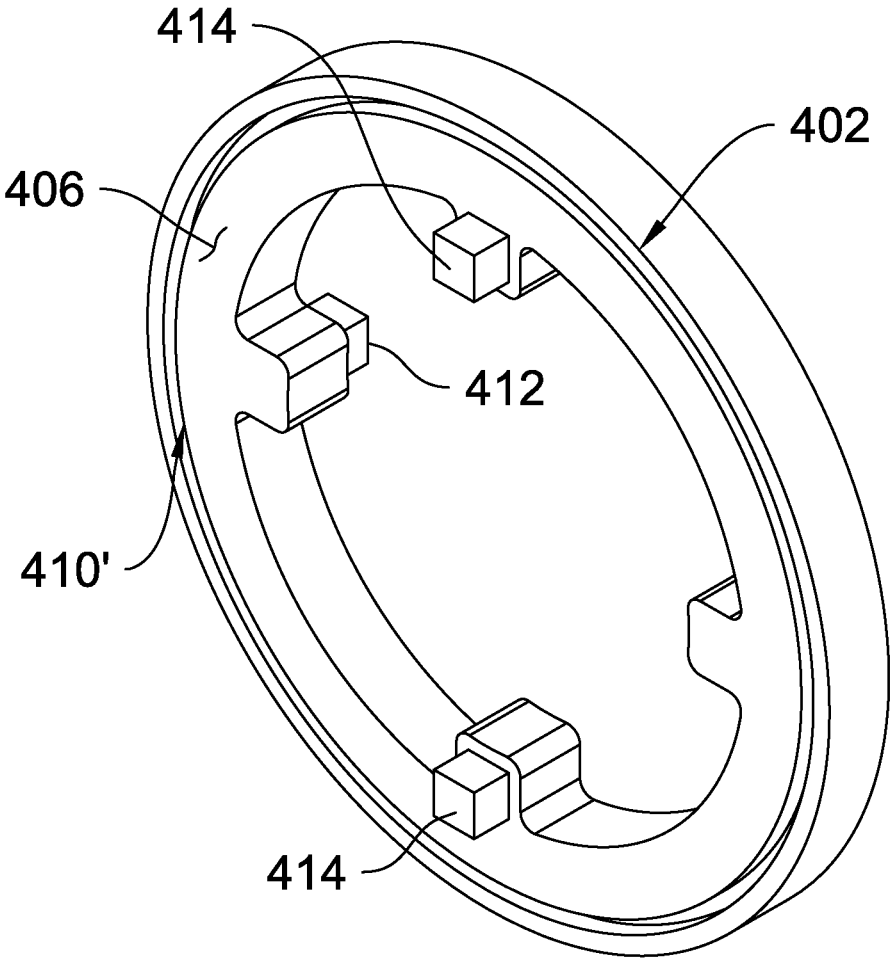
FIG. 12 is a bottom perspective view of an Oldham coupling of the compressor shown in FIGS. 10 and 11.
Figure 13:
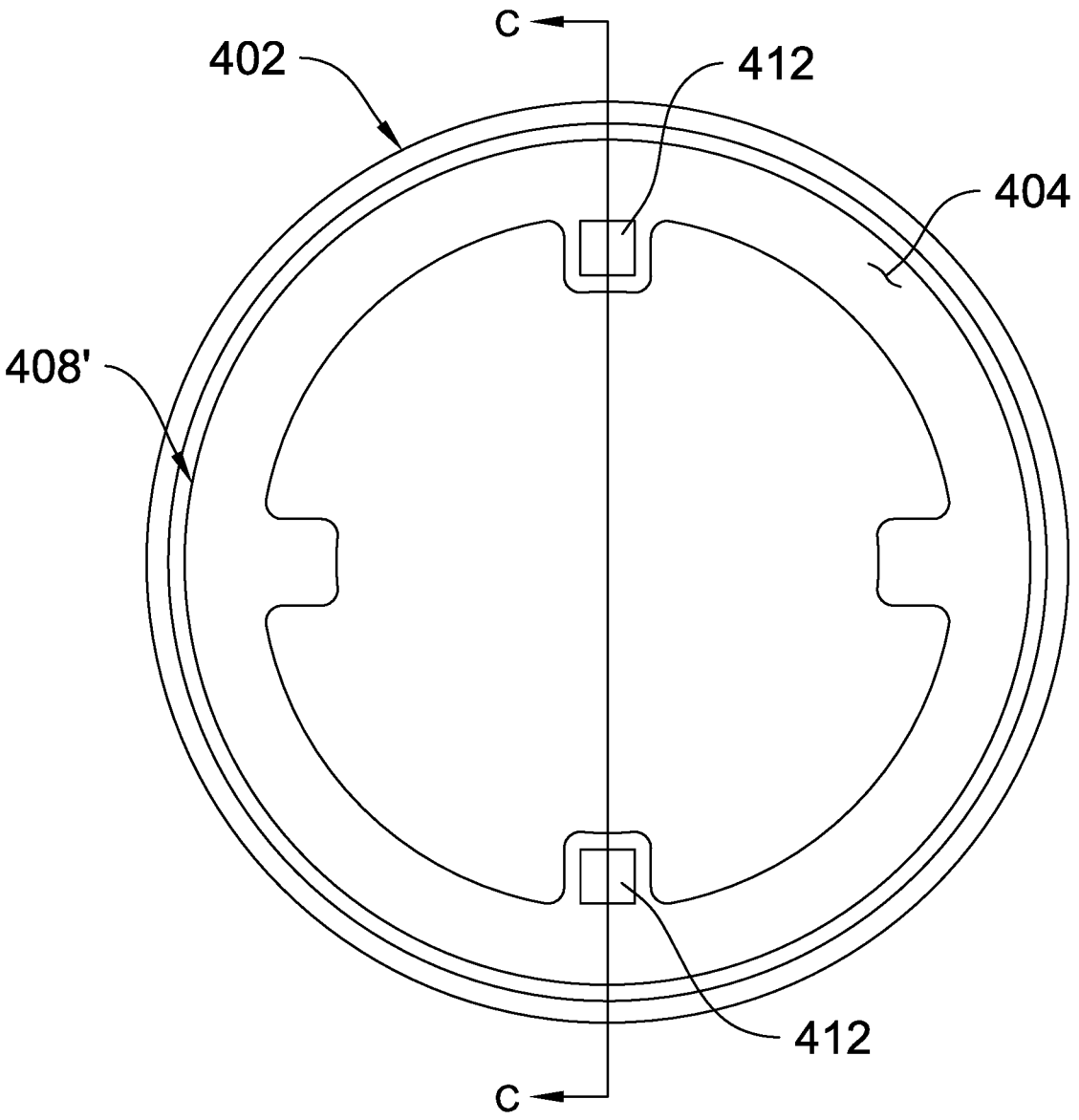
FIG. 13 is a top view of the Oldham coupling shown in FIG. 12.
Figure 14:
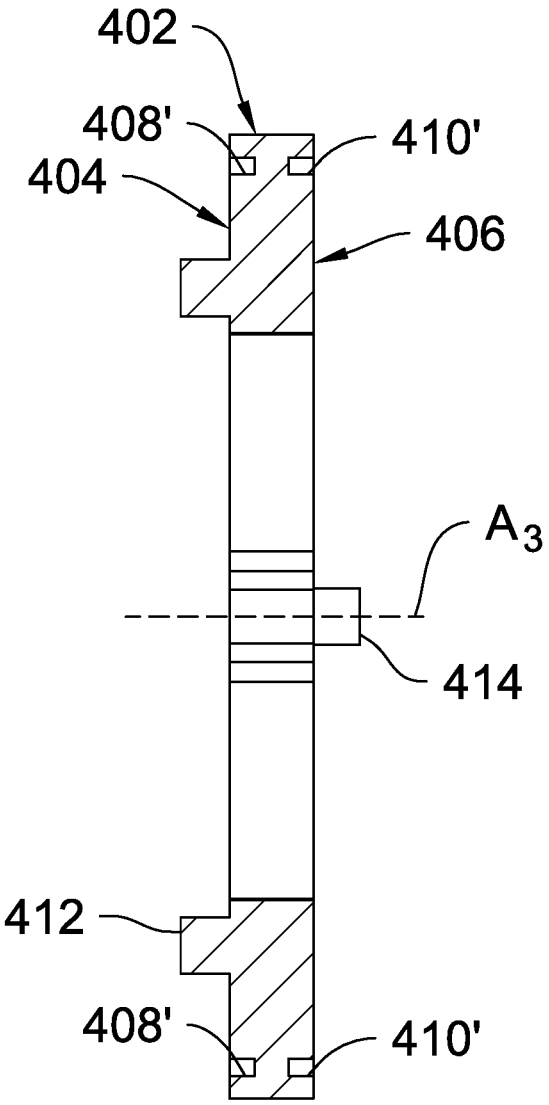
FIG. 14 is a cross-sectional view of the Oldham coupling shown in FIG. 13 taken along line C-C.
Figure 15:
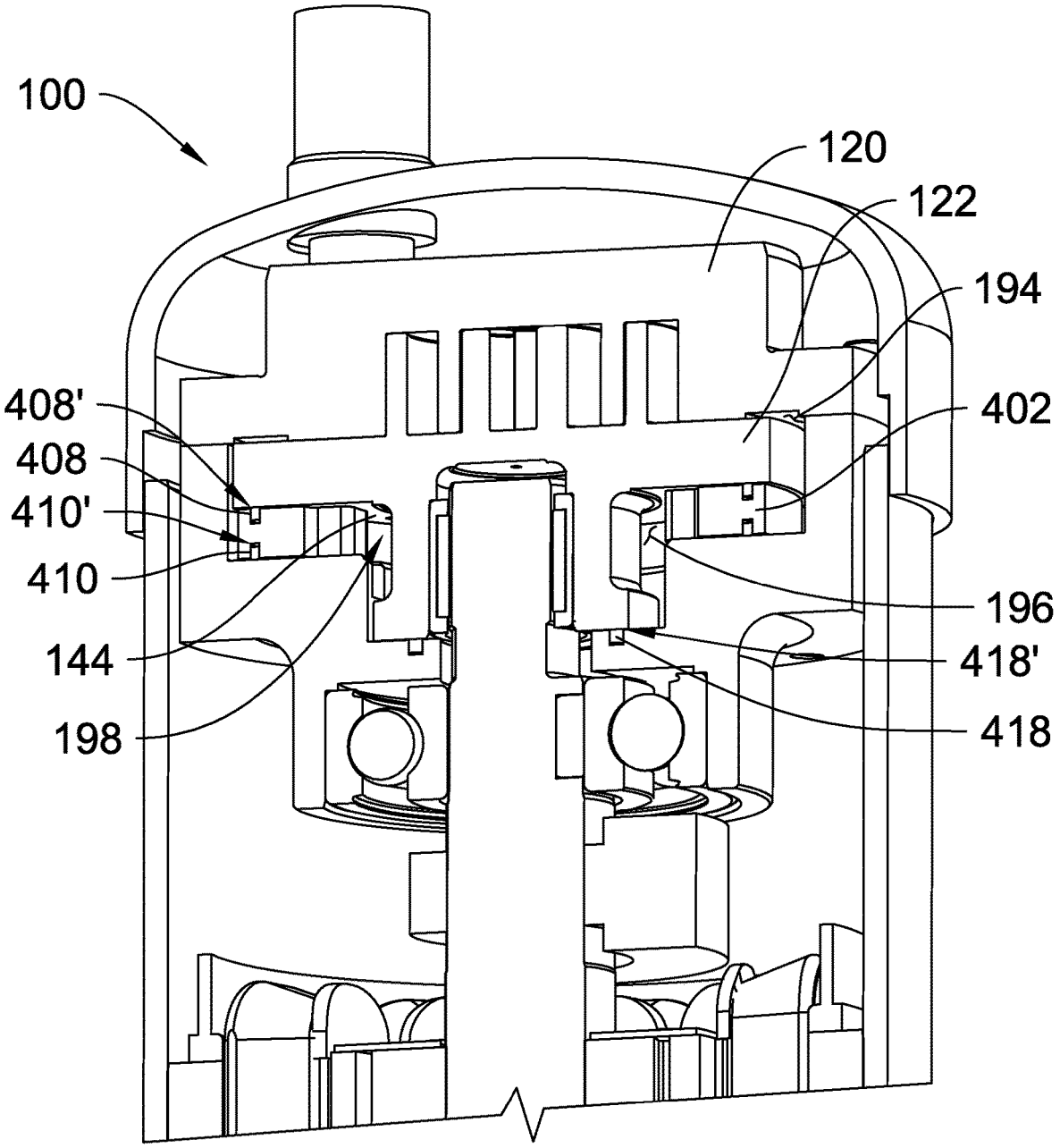
FIG. 15 is a cross-sectional perspective view of the compressor shown in FIGS. 1 and 2 taken along line B-B, illustrating a second seal configuration of the compressor.
Figure 16:
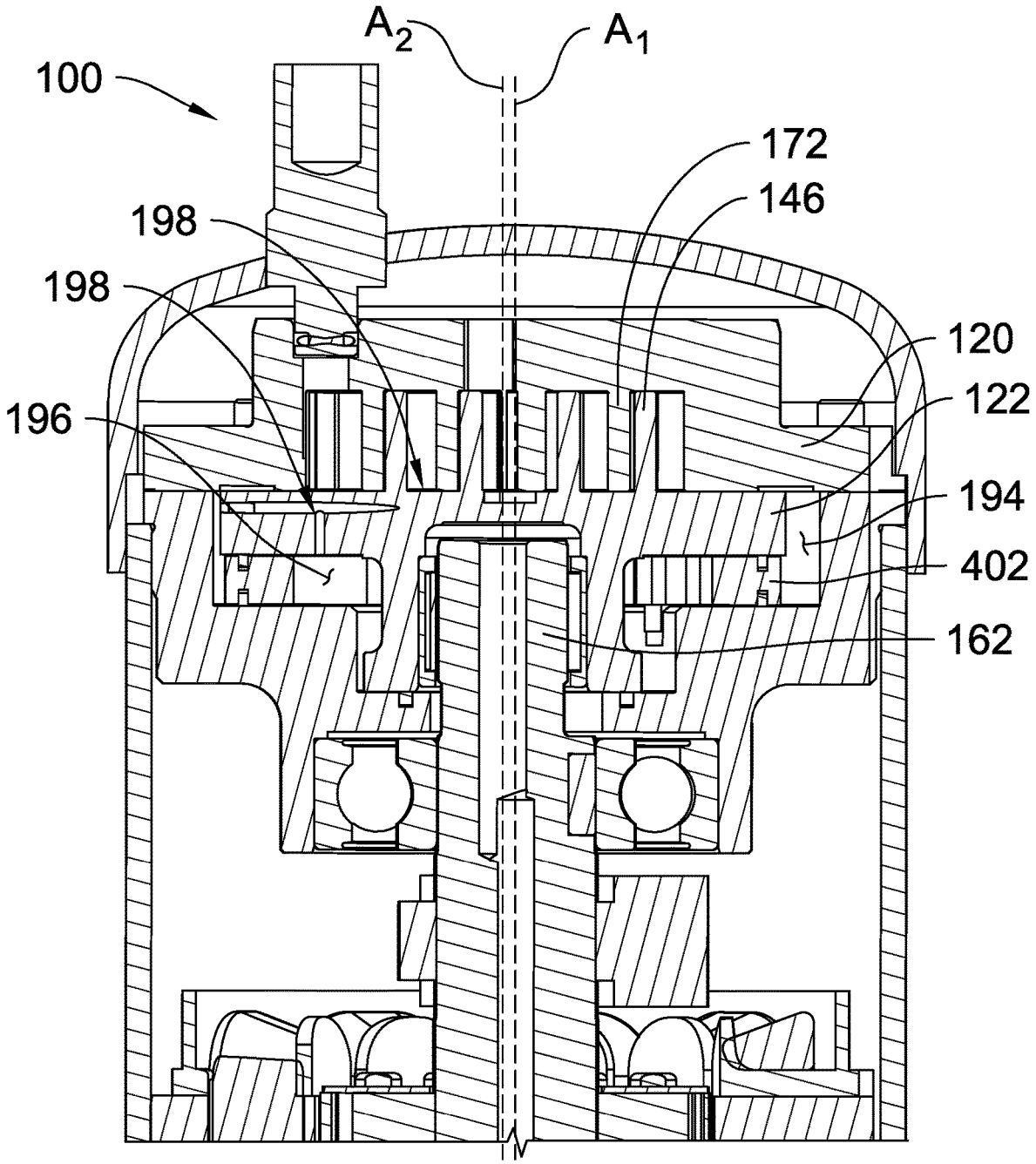
FIG. 16 is a cross-sectional view of the compressor shown in FIGS. 1 and 2 taken along line D-D, illustrating a second seal configuration of the compressor.

Referring to FIGS. 12-14, top surface 404 of coupling 402 includes the channel 408', which is configured to receive at least a portion of the first seal 408. The bottom surface 406 of coupling 402 is oppositely positioned from the top surface 404 and includes the channel 410', which is configured to receive at least a portion of second seal 410. Coupling 402 includes a top protrusion 412 and a bottom protrusion 414, the top and bottom protrusions 412, 414 are configured to engage with the orbiting scroll 122 and/or the main bearing housing 180, either directly or indirectly. As depicted, the coupling 402 includes at least two top protrusions 412 and at least two bottom protrusions 414. The top protrusion 412 extends outwardly from the top surface 404 of the coupling 402 in a direction opposite the bottom surface 406. The top protrusion 412 is configured to movably engage with a protrusion channel 416 of orbiting scroll 122. The bottom protrusion 414 extends outwardly from the bottom surface 406 of the coupling 402 in a direction opposite the top surface 404. The bottom protrusion 414 is configured to movably engage with a protrusion channel (not shown) of the main bearing housing 180. The top and bottom protrusions 412, 414 may extend perpendicularly from top surface 404 and bottom surface 406, respectively.

Figure 10:
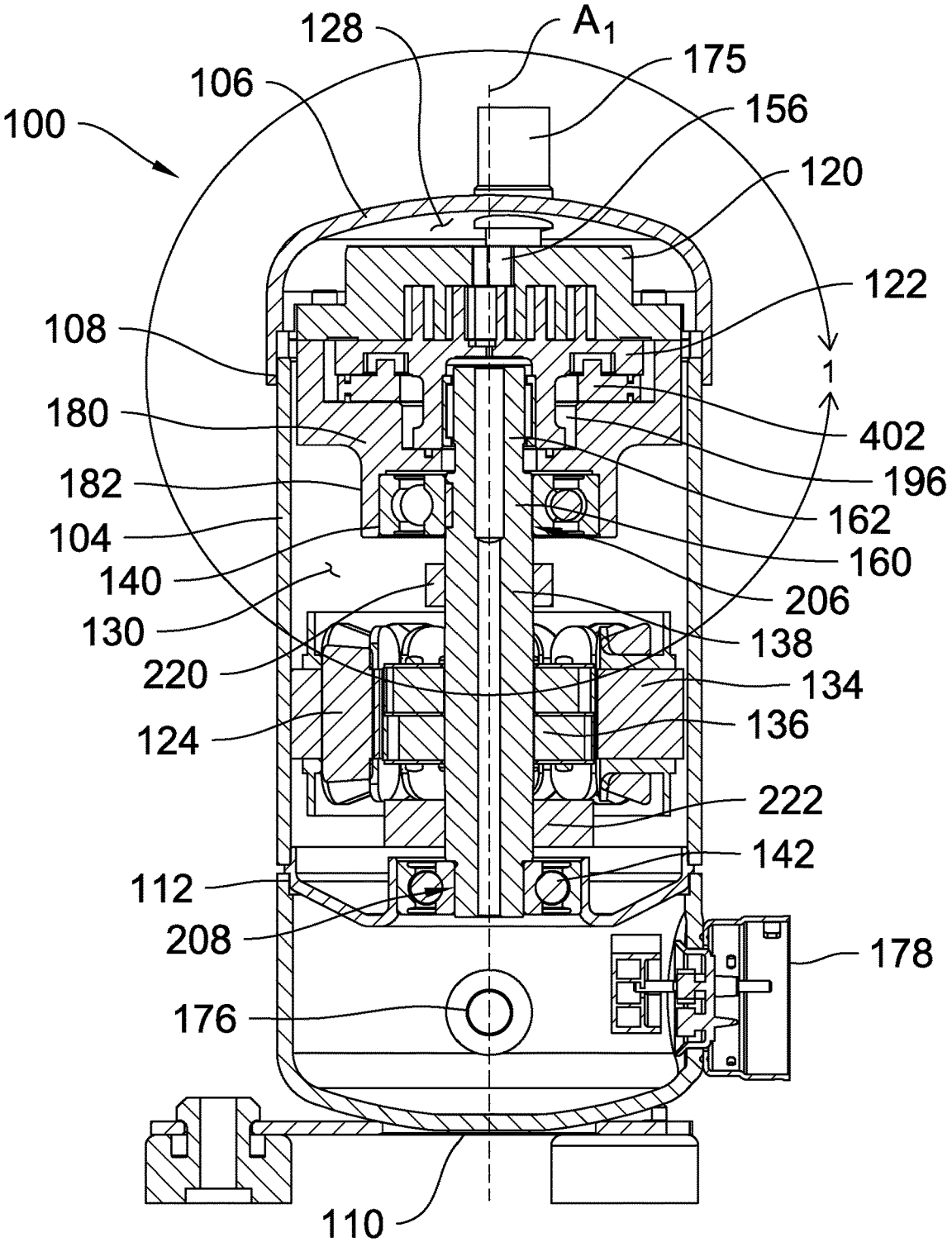
FIG. 10 is a cross-sectional view of the compressor shown in FIGS. 1 and 2 taken along line A-A, illustrating a second seal configuration of the compressor.
Figure 11:
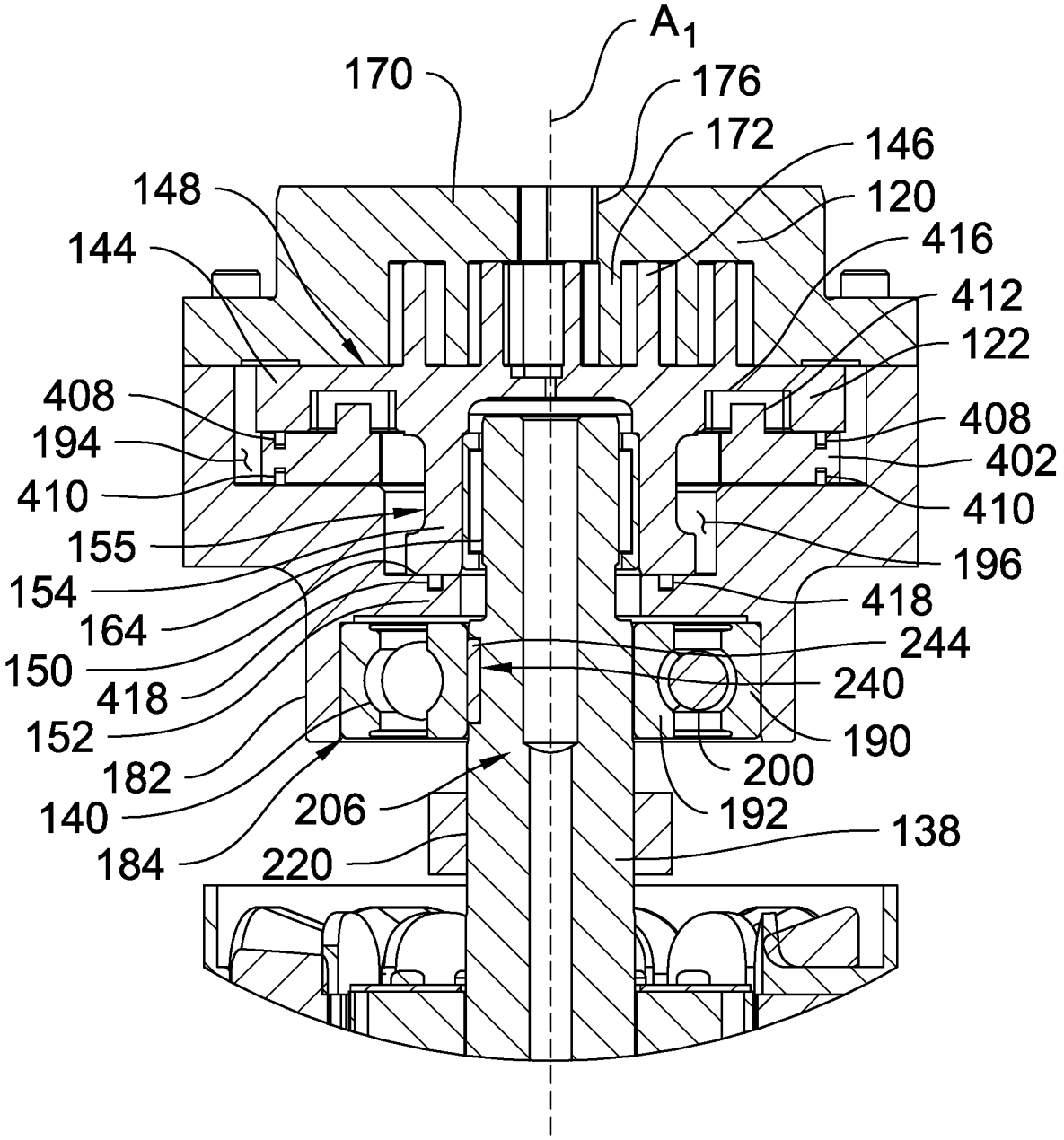
FIG. 11 is a detailed view of the compressor shown in FIG. 10 taken within detail 1, with an endcap and shell removed from the compressor.

Referring to FIGS. 10 and 11, the top protrusion 412 of the coupling 402 is positioned within the protrusion channel 416 of orbiting scroll 122 such that the top protrusion 412 is configured to translate relative to the protrusion channel 416 of the orbiting scroll 122. Similarly, the bottom protrusion 414 of the coupling 402 is positioned within the protrusion channel (not shown) of main bearing housing 180 such that the bottom protrusion 414 is configured to translate relative to the protrusion channel (not shown) of the main bearing housing 180. As depicted in FIGS. 12-14, the top protrusions 412 are oppositely spaced extending from the top surface 404 and the bottom protrusions 414 are oppositely spaced extending from the bottom surface 406. The top protrusions 412 may be spaced about 180 degrees from each other and the bottom protrusions 414 may be spaced about 180 degrees from each other. Thus, one of the top protrusion 412 or the bottom protrusion 414 may be circumferentially spaced every about 90 degrees around longitudinal axis A3 of coupling 402. However, it should be understood that more or less protrusions 412, 414 may be used and may be spaced differently, without departing from the spirit/scope of this disclosure. In operation, coupling 402 may translate relative to orbiting scroll 122 and main bearing housing 180 to ensure the orbiting scroll 122 and the main bearing housing 180 remain indirectly connected during movement. The motion of the orbiting scroll 122 is translational despite moving in two directions. For example, with the Z-axis being parallel to A1, the orbiting scroll 122 moves in the X and Y axis. The top protrusion 412 of the coupling 402 translates within the protrusion channel 416 of the orbiting scroll 122 to enable the coupling 402 to move along the X and Y axes. The bottom protrusion 414 of the coupling 402 translates within the protrusion channel (not shown) of the main bearing housing 180 to enable the coupling 402 to move along the X and Y axes.

As will be discussed in more detail below with respect to FIGS. 31-38, seals 408, 410 may be axially aligned with each other and circumferentially aligned such that the outer portion of each seal 408, 410 is aligned with the other 410, 408. In other instances, seals 408, 410 may be axially aligned but may not be circumferentially aligned. In yet another instance, seals 408, 410 may not be axially aligned. Seals 408, 410 may be aligned axially relative to longitudinal axis A3.

The compressor 100 may also include a hub seal 418 positioned in in contact with the cylindrical hub 154 of the orbiting scroll 122. The hub seal 418 is mounted with respect to the second side 152 of the main bearing housing 180. The hub seal 418 is mounted with respect to the second side 152 of the main bearing housing 180 such that the hub seal 418 is in direct or indirect contact with the cylindrical hub 154 of the orbiting scroll 122. The hub seal 418 may be positioned within a channel 418' such that a surface of the seal 418 is configured to contact the annular flat surface 150 of the cylindrical hub 154. The depth of the channel 418' may depend, in part, on the thickness of the hub seal 418. The amount that the hub seal 418 protrudes from the main bearing housing 180 in the direction of the cylindrical hub 154 may depend, in part, on at least one of the following, the thickness of the hub seal 418, the gap between the cylindrical hub 182 and the main bearing housing 180, the depth of the channel 418', and combinations thereof. Alternatively, the hub seal 418 may be positioned within the channel 418' and extending outwardly from the annular flat surface 150 of the cylindrical hub 154 in the direction of the second side 152 of the main bearing housing 180.

In operation, pressure produced by the series of moving fluid pockets created by the spiral wraps 146, 172 of the orbiting scroll 122 and non-orbiting scroll 120, is released into the port 198. The port 198 is in fluid communication with the intermediate pressure cavity 196, the outside pressure cavity 194, or the intermediate pressure cavity 196 and the outside pressure cavity 194. In some instances, a second port (not shown) may be in fluid communication with the outside cavity 194. The pressure within the intermediate pressure cavity 196 may be different than the pressure within the outside pressure cavity 194. Each cavity 194, 196 is sealed with two or more seals positioned in direct or indirect contact with the main bearing housing 180, the orbiting scroll 122, and/or the coupling 402. For example, compressed gas discharged into outside pressure cavity 194 may be sealed with the first seal 408 and the second seal 410. Gas discharged into intermediate pressure cavity 196 may be sealed with the first seal 408, the second seal 410, and the hub seal 418. Sealing of the pressure cavities 194, 196 prevents at least pressure loss which provides pressure to bias the scrolls against one another to reduce efficiency losses due to leakage between the scroll wraps and minimize the friction losses in the compression mechanism.

In a third embodiment, referring to FIGS. 17-23, compressor 100 includes Oldham coupling 502 positioned at least partially between orbiting scroll 122 and main bearing housing 180. Coupling 502 defines a top surface 504, a bottom surface 506, and a longitudinal axis A3 extending therebetween. The top surface 504 of coupling 502 is positioned at least in close proximity to endplate 144 of orbiting scroll 122 and bottom surface 506 of coupling 502 is positioned at least in close proximity to main bearing housing 180. The top surface 504 of coupling 502 is positioned at least in partial contact with endplate 144 of orbiting scroll 122, either directly or indirectly, and bottom surface 506 of coupling 502 is positioned at least in partial contact with main bearing housing 180, either directly or indirectly.

Compressor 100 includes a first seal 508 mounted with respect to endplate 144 of orbiting scroll 122. First seal 508 is mounted with respect to the endplate 144 and positioned to extend in a direction of coupling 502. First seal 508 is mounted with respect to the endplate 144 such that first seal 508 is in direct or indirect contact with coupling 502. First seal 508 may be positioned within a channel 508' such that a surface of the seal is configured to contact top surface 504 of coupling 502. The depth of the channel 508' may depend, in part, on the thickness of the first seal 508. The amount that first seal protrudes from endplate 144 in the direction of coupling 502 may depend, in part, on at least one of the following, the thickness of first seal 508, the gap between coupling 502 and endplate 144, the depth of the channel 508', and combinations thereof. The channel 508' may extend axially relative to longitudinal axis A3 of coupling 502.

The compressor 100 includes a second seal 510 mounted with respect to the main bearing housing 180. Second seal 510 is mounted with respect to the main bearing housing 180 and positioned to extend in a direction of coupling 502. Second seal 510 is mounted with respect to the main bearing housing 180 such that second seal 510 is in direct or indirect contact with coupling 502. Second seal 510 may be positioned within a channel 510' such that a surface of the seal is configured to contact bottom surface 506 of coupling 502. The depth of the channel 510' may depend, in part, on the thickness of the second seal 510. The amount that second seal protrudes from the main bearing housing 180 in the direction of coupling 502 may depend, in part, on at least one of the following, the thickness of second seal 510, the gap between coupling 502 and main bearing housing 180, the depth of the channel 510', and combinations thereof. The channel 510' may extend axially relative to longitudinal axis A3 of coupling 502.

Figure 19:
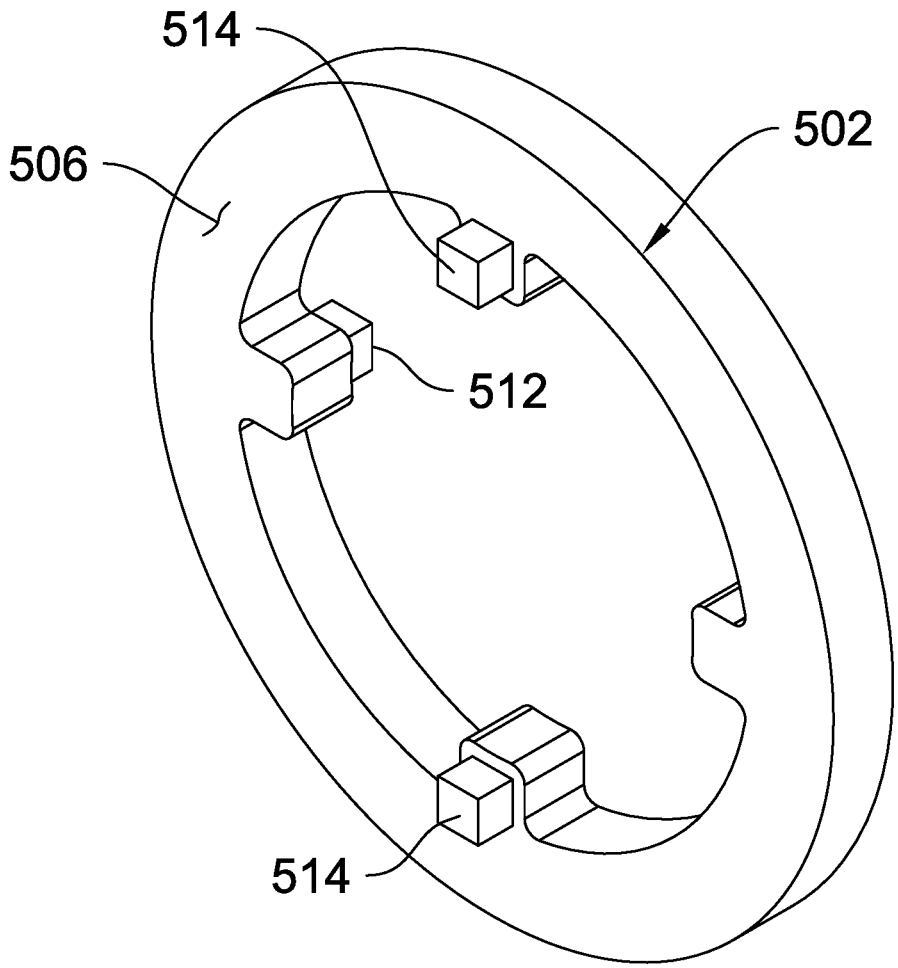
FIG. 19 is a bottom perspective view of an Oldham coupling of the compressor shown in FIGS. 17 and 18.
Figure 20:
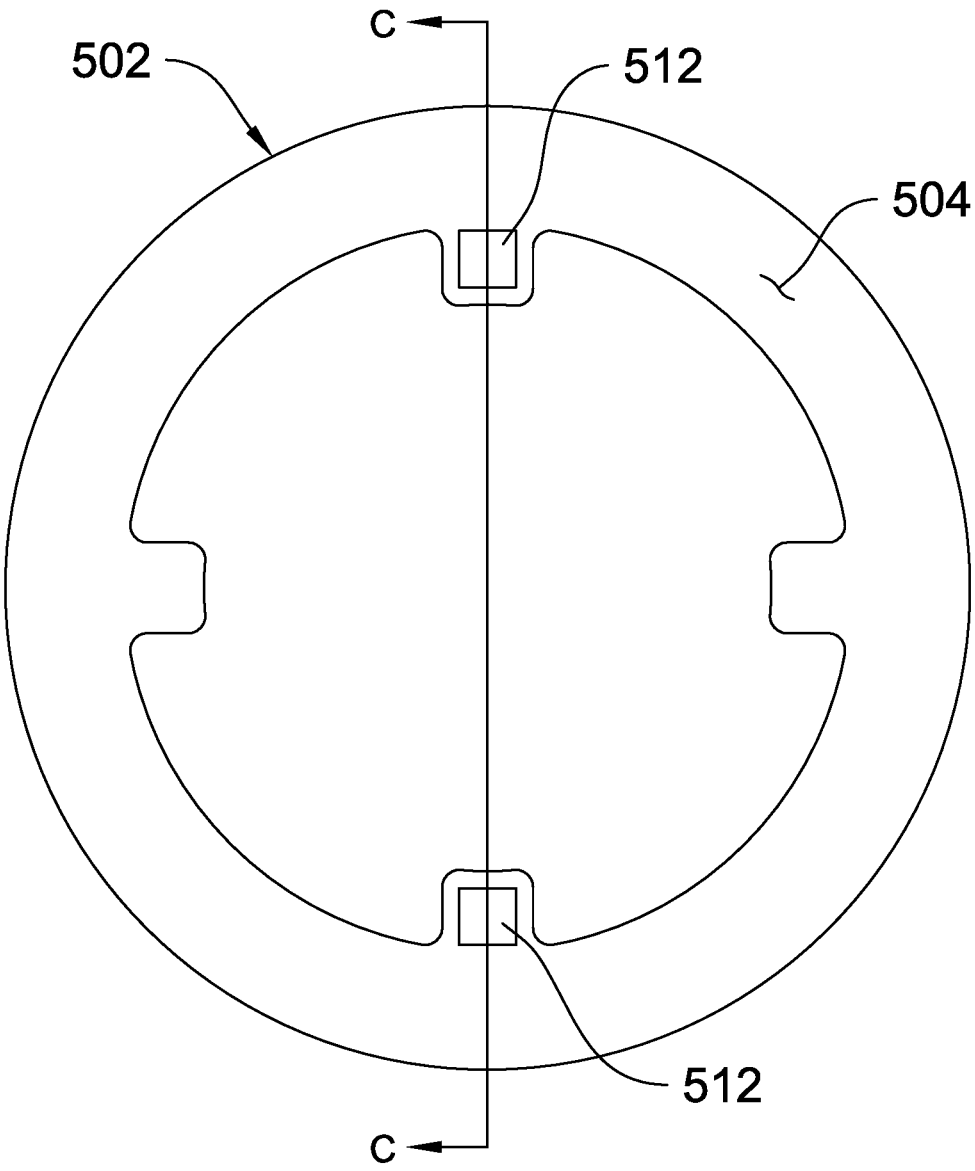
FIG. 20 is a top view of the Oldham coupling shown in FIG. 19.
Figure 21:
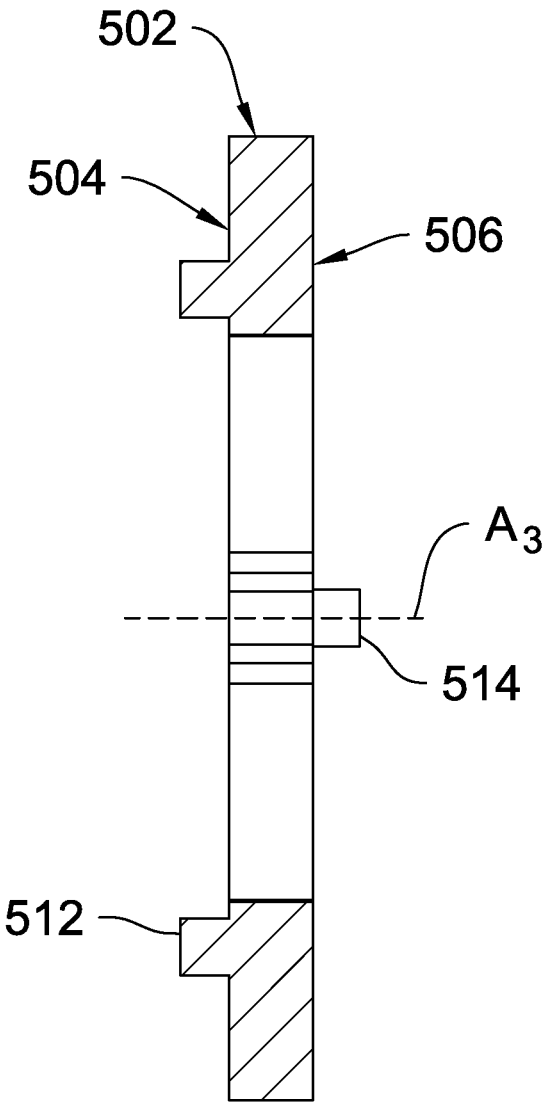
FIG. 21 is a cross-sectional view of the Oldham coupling shown in FIG. 20 taken along line C-C.
Figure 22:
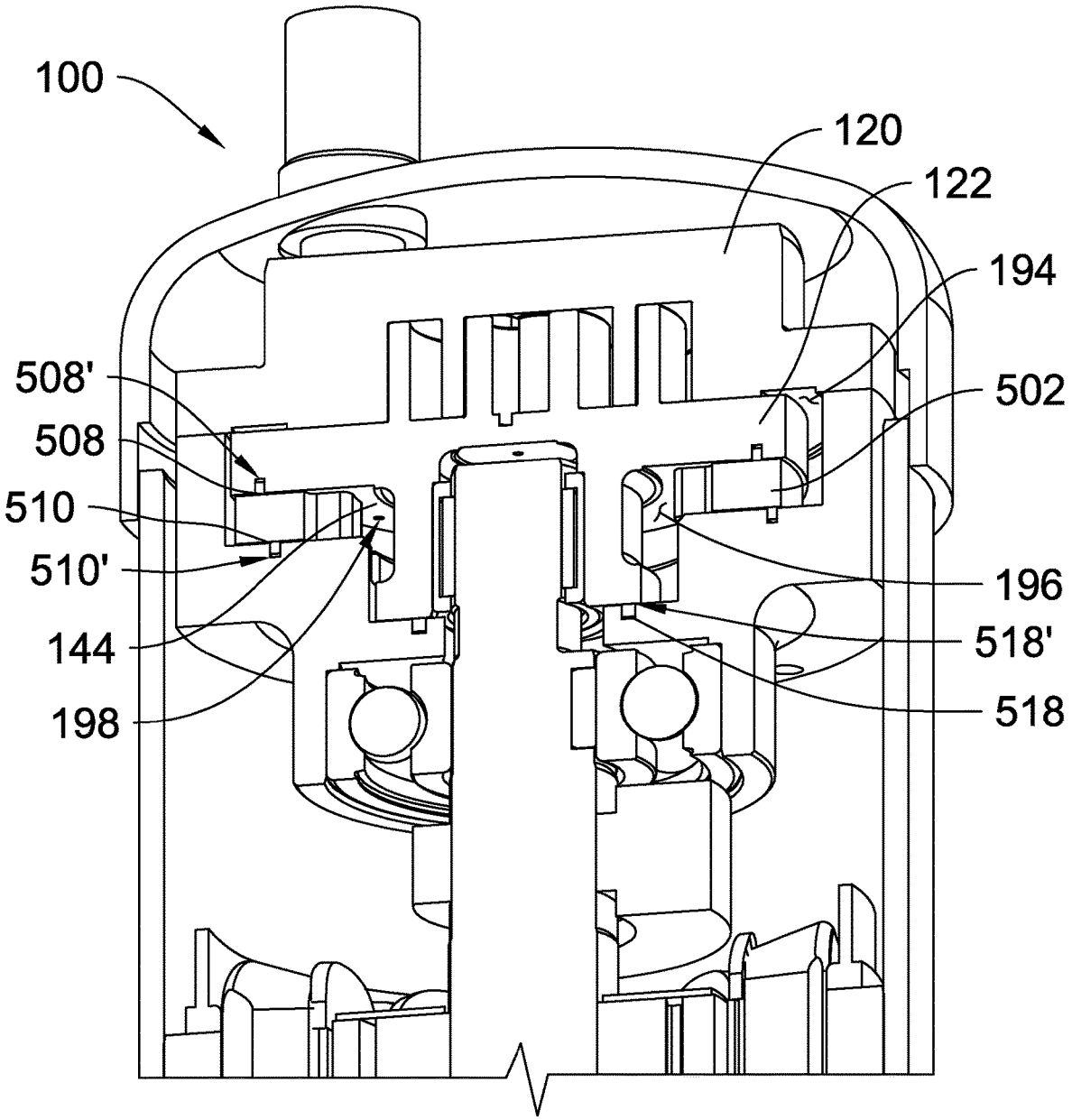
FIG. 22 is a cross-sectional perspective view of the compressor shown in FIGS. 1 and 2 taken along line B-B, illustrating a third seal configuration of the compressor.
Figure 23:
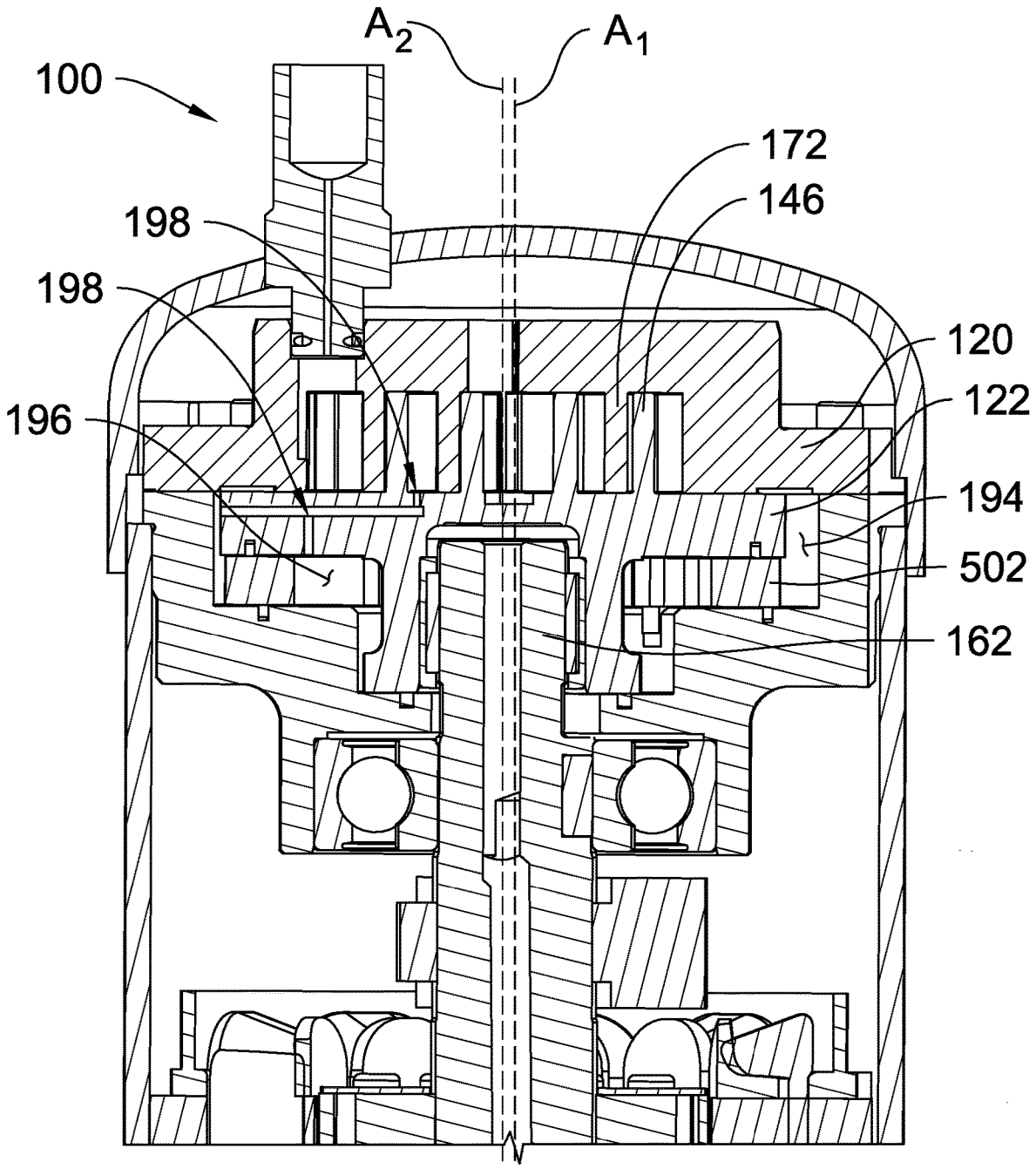
FIG. 23 is a cross-sectional view of the compressor shown in FIGS. 1 and 2 taken along line D-D, illustrating a third seal configuration of the compressor.

Referring to FIGS. 19-21, top surface 504 of coupling 502 is substantially planar and does not include a channel. The bottom surface 506 of coupling 502 is oppositely positioned from the top surface 504 and is substantially planar and does not include a channel. Coupling 502 includes a top protrusion 512 and a bottom protrusion 514, the top and bottom protrusions 512, 514 are configured to engage with the orbiting scroll 122 and/or the main bearing housing 180, either directly or indirectly. As depicted, the coupling 502 includes at least two top protrusions 512 and at least two bottom protrusions 514. The top protrusion 512 extends outwardly from the top surface 504 of the coupling 502 in a direction opposite the bottom surface 506. The top protrusion 512 is configured to movably engage with a protrusion channel 516 of orbiting scroll 122. The bottom protrusion 514 extends outwardly from the bottom surface 506 of the coupling 502 in a direction opposite the top surface 504. The bottom protrusion 514 is configured to movably engage with a protrusion channel (not shown) of the main bearing housing 180. The top and bottom protrusions 512, 514 may extend perpendicularly from top surface 504 and bottom surface 506, respectively.

Figure 17:
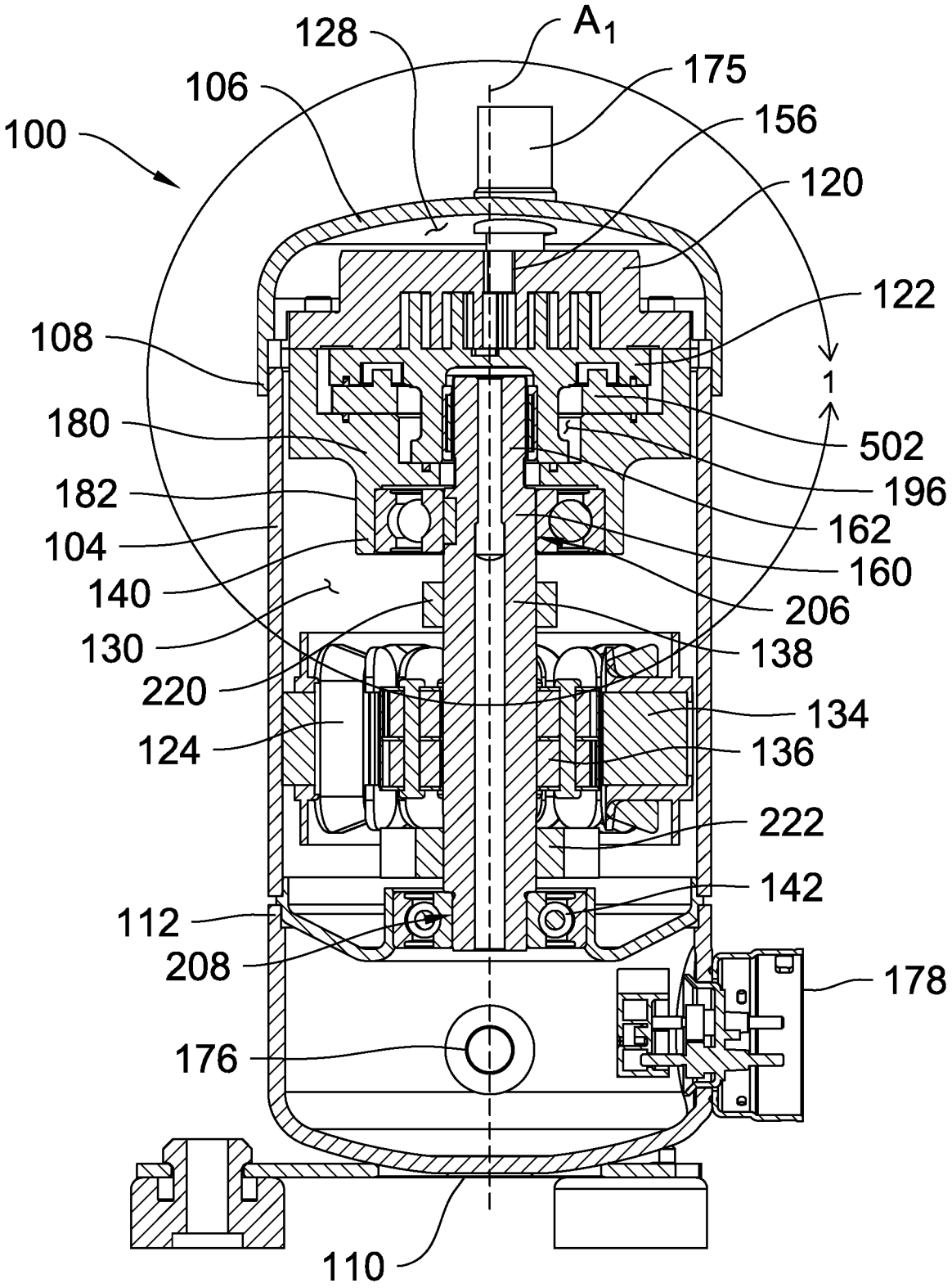
FIG. 17 is a cross-sectional view of the compressor shown in FIGS. 1 and 2 taken along line A-A, illustrating a third seal configuration of the compressor.
Figure 18:
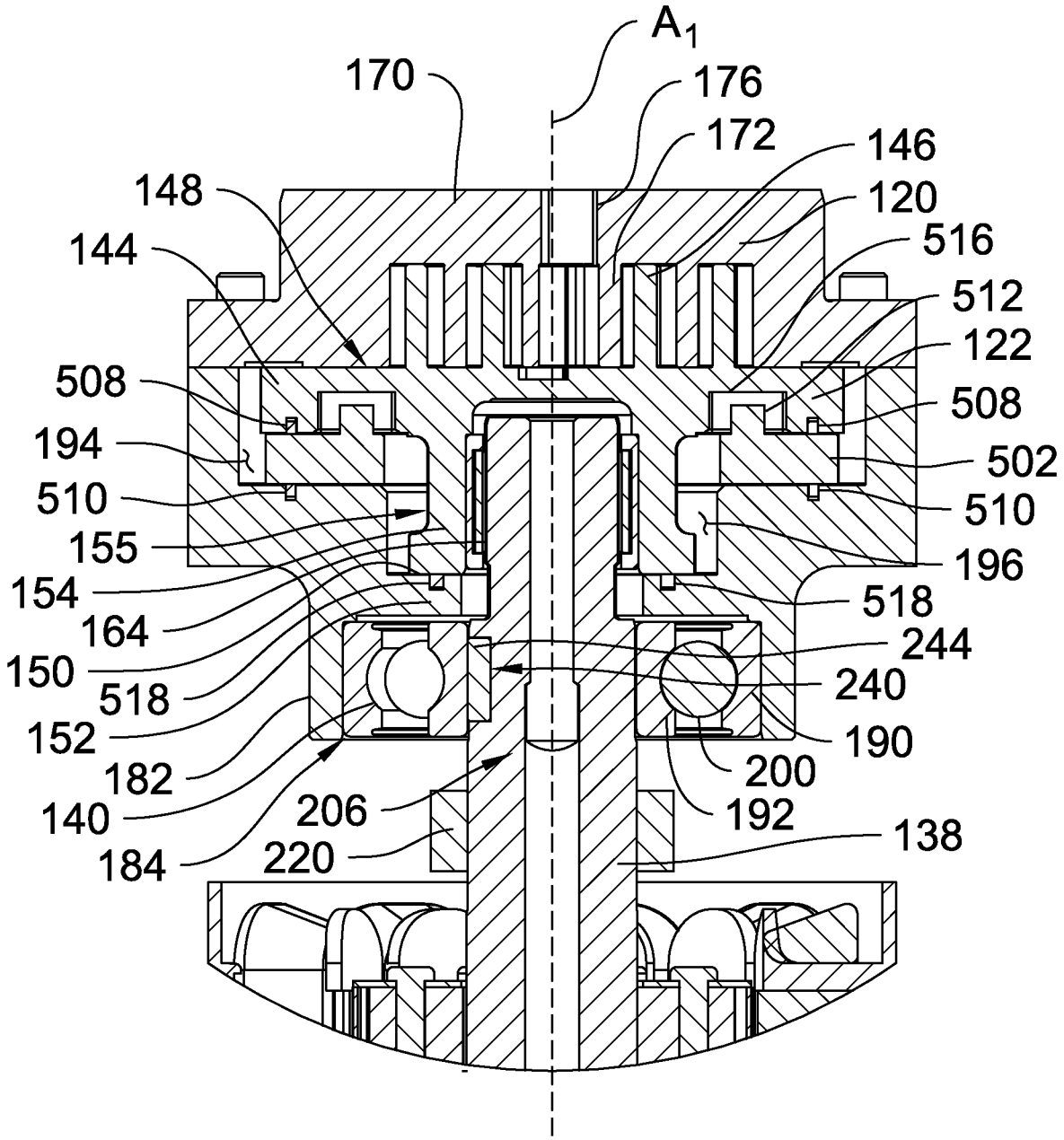
FIG. 18 is a detailed view of the compressor shown in FIG. 17 taken within detail 1, with an endcap and shell removed from the compressor.

Referring to FIGS. 17 and 18, the top protrusion 512 of the coupling 502 is positioned within the protrusion channel 516 of orbiting scroll 122 such that the top protrusion 512 is configured to translate relative to the protrusion channel 516 of the orbiting scroll 122. Similarly, the bottom protrusion 514 of the coupling 502 is positioned within the protrusion channel (not shown) of main bearing housing 180 such that the bottom protrusion 514 is configured to translate relative to the protrusion channel (not shown) of the main bearing housing 180. As depicted in FIGS. 19-21, the top protrusions 512 are oppositely spaced extending from the top surface 504 and the bottom protrusions 514 are oppositely spaced extending from the bottom surface 506. The top protrusions 512 may be spaced about 180 degrees from each other and the bottom protrusions 514 may be spaced about 180 degrees from each other. Thus, one of the top protrusion 512 or the bottom protrusion 514 may be circumferentially spaced every about 90 degrees around longitudinal axis A3 of coupling 502. However, it should be understood that more or less protrusions 512, 514 may be used and may be spaced differently, without departing from the spirit/scope of this disclosure. In operation, coupling 502 may translate relative to orbiting scroll 122 and main bearing housing 180 to ensure the orbiting scroll 122 and the main bearing housing 180 remain indirectly connected during movement. The motion of the orbiting scroll 122 is translational despite moving in two directions. For example, with the Z-axis being parallel to A1, the orbiting scroll 122 moves in the X and Y axis. The top protrusion 512 of the coupling 502 translates within the protrusion channel 516 of the orbiting scroll 122 to enable the coupling 502 to move along the X and Y axes. The bottom protrusion 514 of the coupling 502 translates within the protrusion channel (not shown) of the main bearing housing 180 to enable the coupling 502 to move along the X and Y axes.

As will be discussed in more detail below with respect to FIGS. 31-38, seals 508, 510 may be axially aligned with each other and circumferentially aligned such that the outer portion of each seal 508, 510 is aligned with the other 510, 508. In other instances, seals 508, 510 may be axially aligned but may not be circumferentially aligned. In yet another instance, seals 508, 510 may not be axially aligned. Seals 508, 510 may be aligned axially relative to longitudinal axis A3.

The compressor 100 may also include a hub seal 518 positioned in in contact with the cylindrical hub 154 of the orbiting scroll 122. The hub seal 518 is mounted with respect to the second side 152 of the main bearing housing 180. The hub seal 518 is mounted with respect to the second side 152 of the main bearing housing 180 such that the hub seal 518 is in direct or indirect contact with the cylindrical hub 154 of the orbiting scroll 122. The hub seal 518 may be positioned within a channel 518' such that a surface of the seal 518 is configured to contact the annular flat surface 150 of the cylindrical hub 154. The depth of the channel 518' may depend, in part, on the thickness of the hub seal 518. The amount that the hub seal 518 protrudes from the main bearing housing 180 in the direction of the cylindrical hub 154 may depend, in part, on at least one of the following, the thickness of the hub seal 518, the gap between the cylindrical hub 182 and the main bearing housing 180, the depth of the channel 518', and combinations thereof. Alternatively, the hub seal 518 may be positioned within the channel 518' and extending outwardly from the annular flat surface 150 of the cylindrical hub 154 in the direction of the second side 152 of the main bearing housing 180.

In operation, pressure produced by the series of moving fluid pockets created by the spiral wraps 146, 172 of the orbiting scroll 122 and non-orbiting scroll 120, is released into the port 198. The port 198 is in fluid communication with the intermediate pressure cavity 196, the outside pressure cavity 194, or the intermediate pressure cavity 196 and the outside pressure cavity 194. In some instances, a second port (not shown) may be in fluid communication with the outside cavity 194. The pressure within the intermediate pressure cavity 196 may be different than the pressure within the outside pressure cavity 194. Each cavity 194, 196 is sealed with two or more seals positioned in direct or indirect contact with the main bearing housing 180, the orbiting scroll 122, and/or the coupling 502. For example, compressed gas discharged into outside pressure cavity 194 may be sealed with the first seal 508 and the second seal 510. Gas discharged into intermediate pressure cavity 196 may be sealed with the first seal 508, the second seal 510, and the hub seal 518. Sealing of the pressure cavities 194, 196 prevents at least pressure loss which provides pressure to bias the scrolls against one another to reduce efficiency losses due to leakage between the scroll wraps and minimize the friction losses in the compression mechanism.

In a fourth embodiment, referring to FIGS. 24-30, compressor 100 includes Oldham coupling 602 positioned at least partially between orbiting scroll 122 and main bearing housing 180. Coupling 602 defines a top surface 604, a bottom surface 606, and a longitudinal axis A3 extending therebetween. The top surface 604 of coupling 602 is positioned at least in close proximity to endplate 144 of orbiting scroll 122 and bottom surface 606 of coupling 602 is positioned at least in close proximity to main bearing housing 180. The top surface 604 of coupling 602 is positioned at least in partial contact with endplate 144 of orbiting scroll 122, either directly or indirectly, and bottom surface 606 of coupling 602 is positioned at least in partial contact with main bearing housing 180, either directly or indirectly.

Compressor 100 includes a first seal 608 mounted with respect to the top surface 604 of the coupling 602. First seal 608 is mounted with respect to the top surface 604 of the coupling 602 and positioned to extend in a direction of the orbiting scroll 122. First seal 608 is mounted with respect to the top surface 604 of the coupling 602 such that first seal 608 is in direct or indirect contact with the endplate 144 of orbiting scroll 122. First seal 608 may be positioned within a channel 608' such that a surface of the seal is configured to contact the endplate 144 of the orbiting scroll 122. The depth of the channel 608' may depend, in part, on the thickness of the first seal 608. The amount that first seal 608 protrudes from the top surface 604 of the coupling 602 in the direction of the endplate 144 of the orbiting scroll 122 may depend, in part, on at least one of the following, the thickness of first seal 608, the gap between coupling 602 and endplate 144, the depth of the channel 608', and combinations thereof. The channel 608' may extend axially relative to longitudinal axis A3 of coupling 602.

The compressor 100 includes a second seal 610 mounted with respect to the main bearing housing 180. Second seal 610 is mounted with respect to the main bearing housing 180 and positioned to extend in a direction of coupling 602. Second seal 610 is mounted with respect to the main bearing housing 180 such that second seal 610 is in direct or indirect contact with coupling 602. Second seal 610 may be positioned within a channel 610' such that a surface of the seal is configured to contact bottom surface 606 of coupling 602. The depth of the channel 610' may depend, in part, on the thickness of the second seal 610. The amount that second seal protrudes from the main bearing housing 180 in the direction of coupling 602 may depend, in part, on at least one of the following, the thickness of second seal 610, the gap between coupling 602 and main bearing housing 180, the depth of the channel 610', and combinations thereof. The channel 610' may extend axially relative to longitudinal axis A3 of coupling 602.

Figure 26:
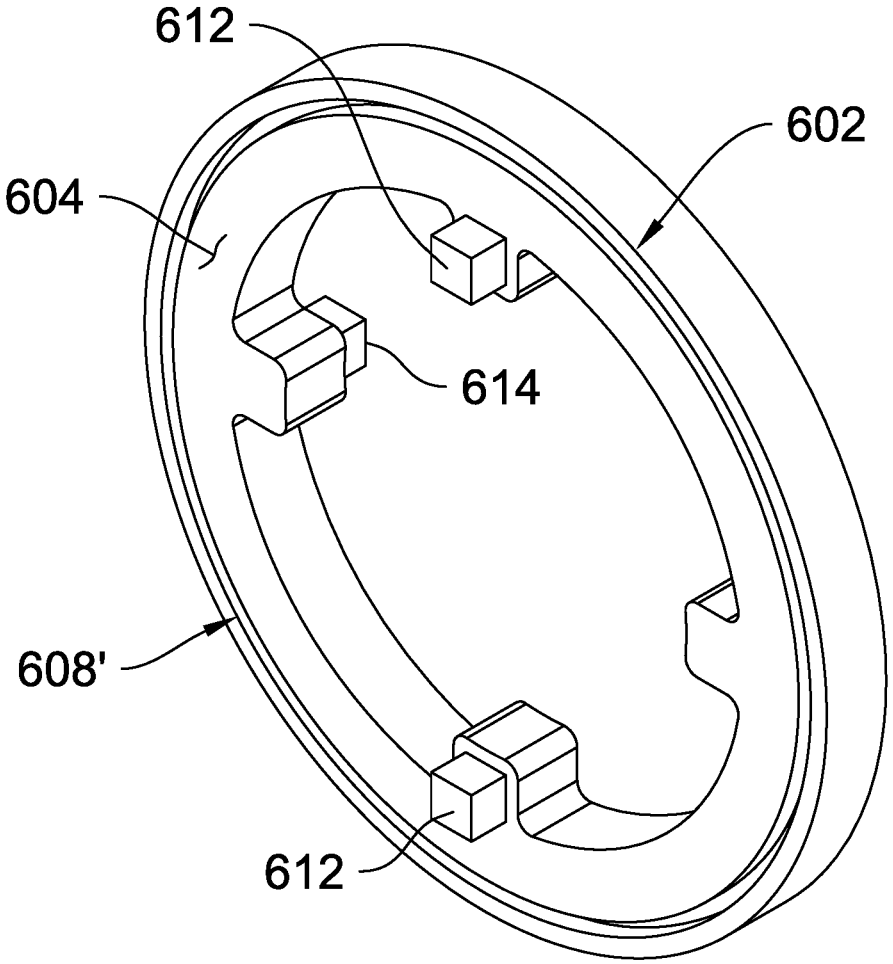
FIG. 26 is a top perspective view of an Oldham coupling of the compressor shown in FIGS. 24 and 25.
Figure 27:
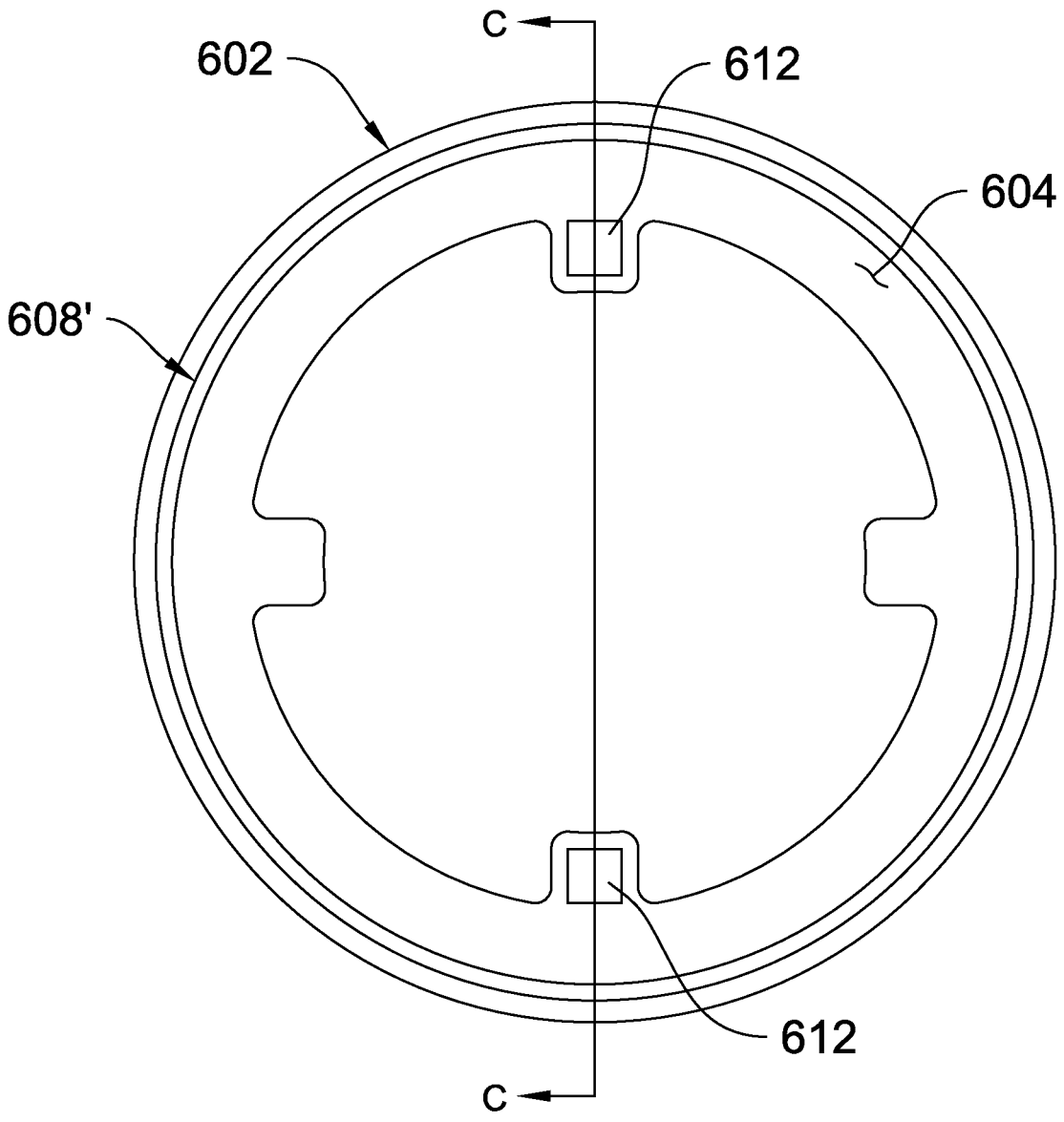
FIG. 27 is a top view of the Oldham coupling shown in FIG. 26.
Figure 28:
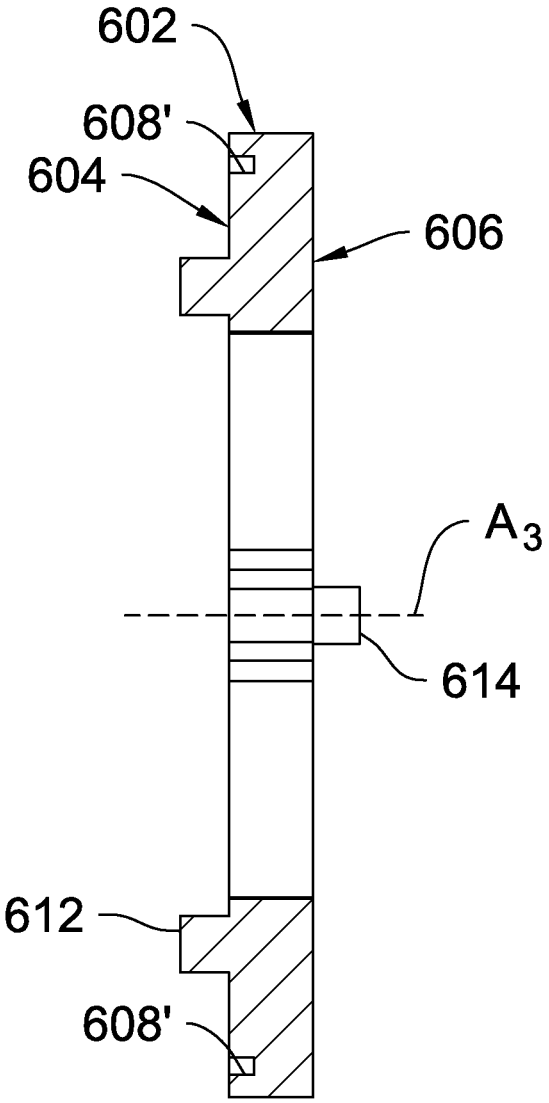
FIG. 28 is a cross-sectional view of the Oldham coupling shown in FIG. 27 taken along line C-C.
Figure 29:
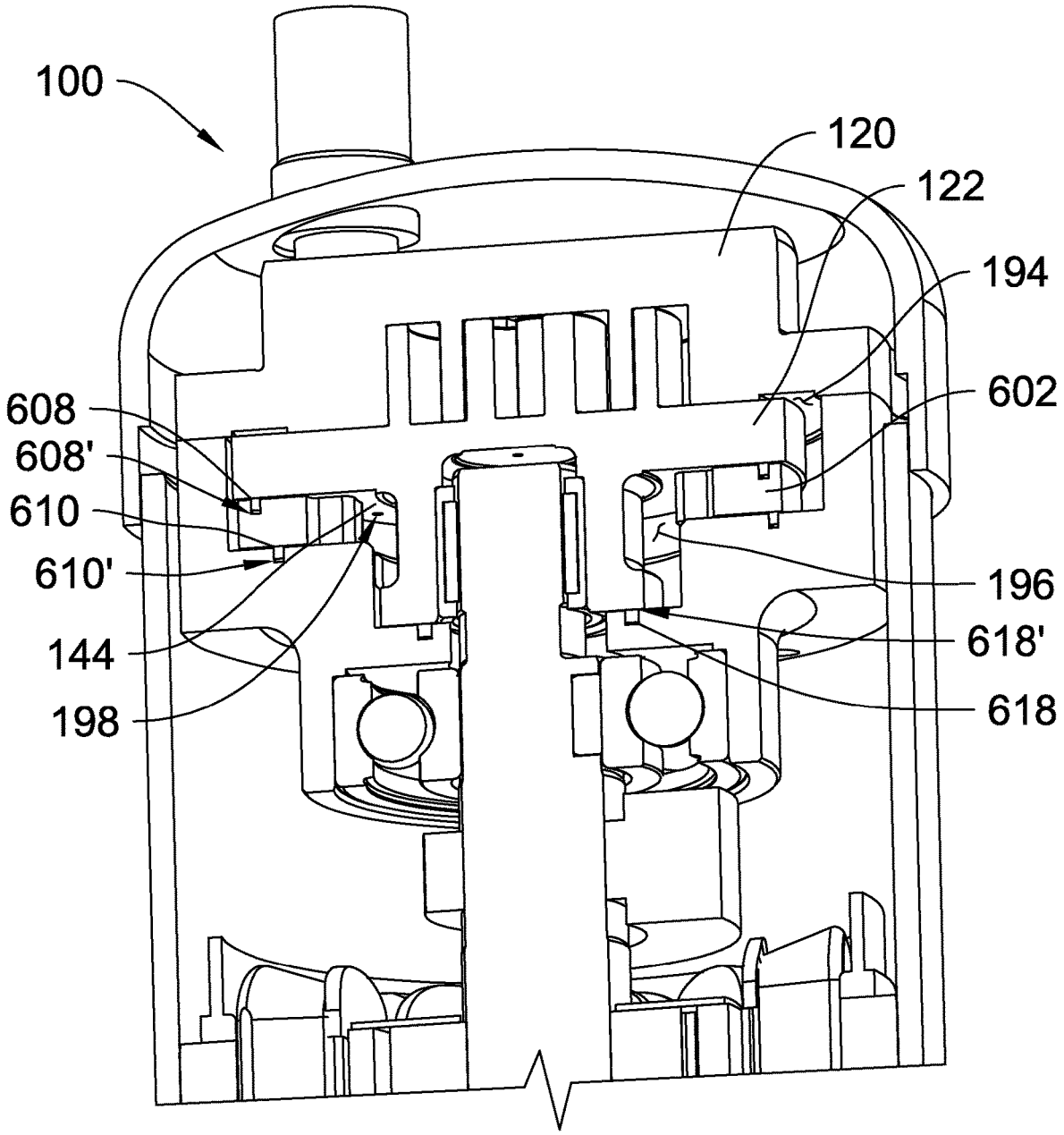
FIG. 29 is a cross-sectional perspective view of the compressor shown in FIGS. 1 and 2 taken along line B-B, illustrating a fourth seal configuration of the compressor.
Figure 30:
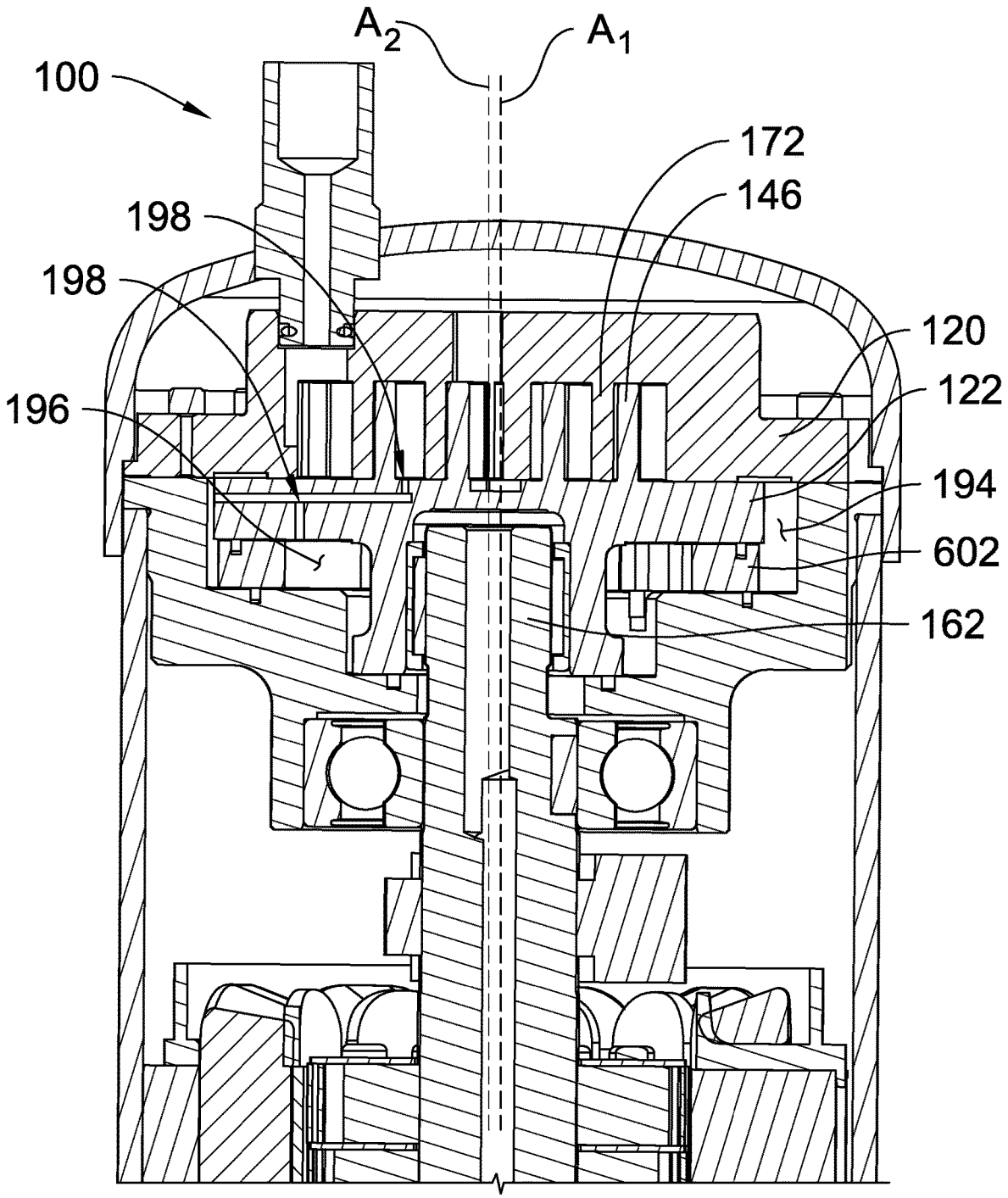
FIG. 30 is a cross-sectional view of the compressor shown in FIGS. 1 and 2 taken along line D-D, illustrating a fourth seal configuration of the compressor.

Referring to FIGS. 26-28, top surface 604 of coupling 602 includes the channel 608', which is configured to receive at least a portion of the first seal 608. The bottom surface 606 of coupling 602 is oppositely positioned from the top surface 604 and is substantially planar and does not include a channel. Coupling 602 includes a top protrusion 612 and a bottom protrusion 614, the top and bottom protrusions 612, 614 are configured to engage with the orbiting scroll 122 and/or the main bearing housing 180, either directly or indirectly. As depicted, the coupling 602 includes at least two top protrusions 612 and at least two bottom protrusions 614. The top protrusion 612 extends outwardly from the top surface 604 of the coupling 602 in a direction opposite the bottom surface 606. The top protrusion 612 is configured to movably engage with a protrusion channel 616 of orbiting scroll 122. The bottom protrusion 614 extends outwardly from the bottom surface 606 of the coupling 602 in a direction opposite the top surface 604. The bottom protrusion 614 is configured to movably engage with a protrusion channel (not shown) of the main bearing housing 180. The top and bottom protrusions 612, 614 may extend perpendicularly from top surface 604 and bottom surface 606, respectively.

Figure 24:
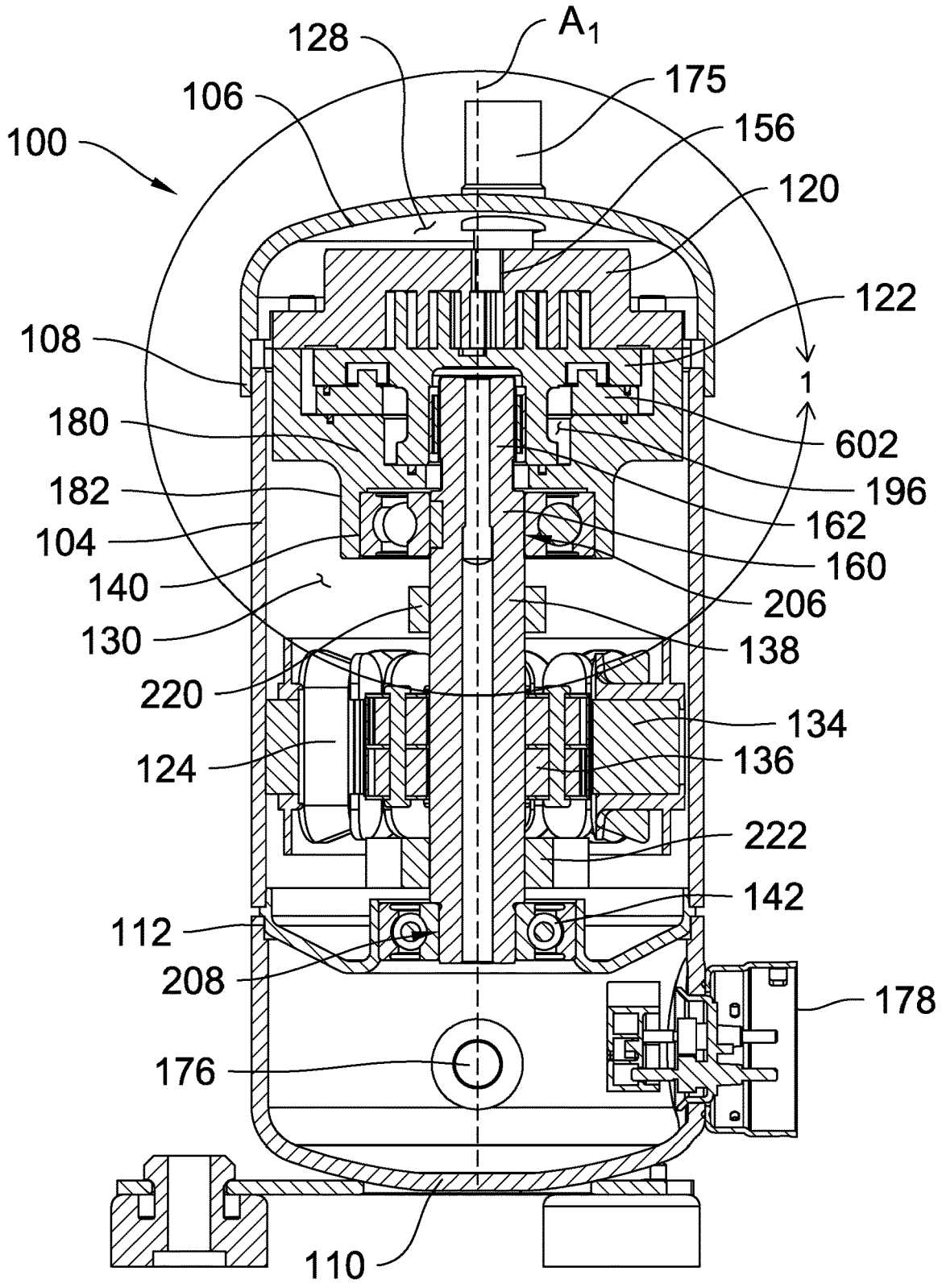
FIG. 24 is a cross-sectional view of the compressor shown in FIGS. 1 and 2 taken along line A-A, illustrating a fourth seal configuration of the compressor.
Figure 25:
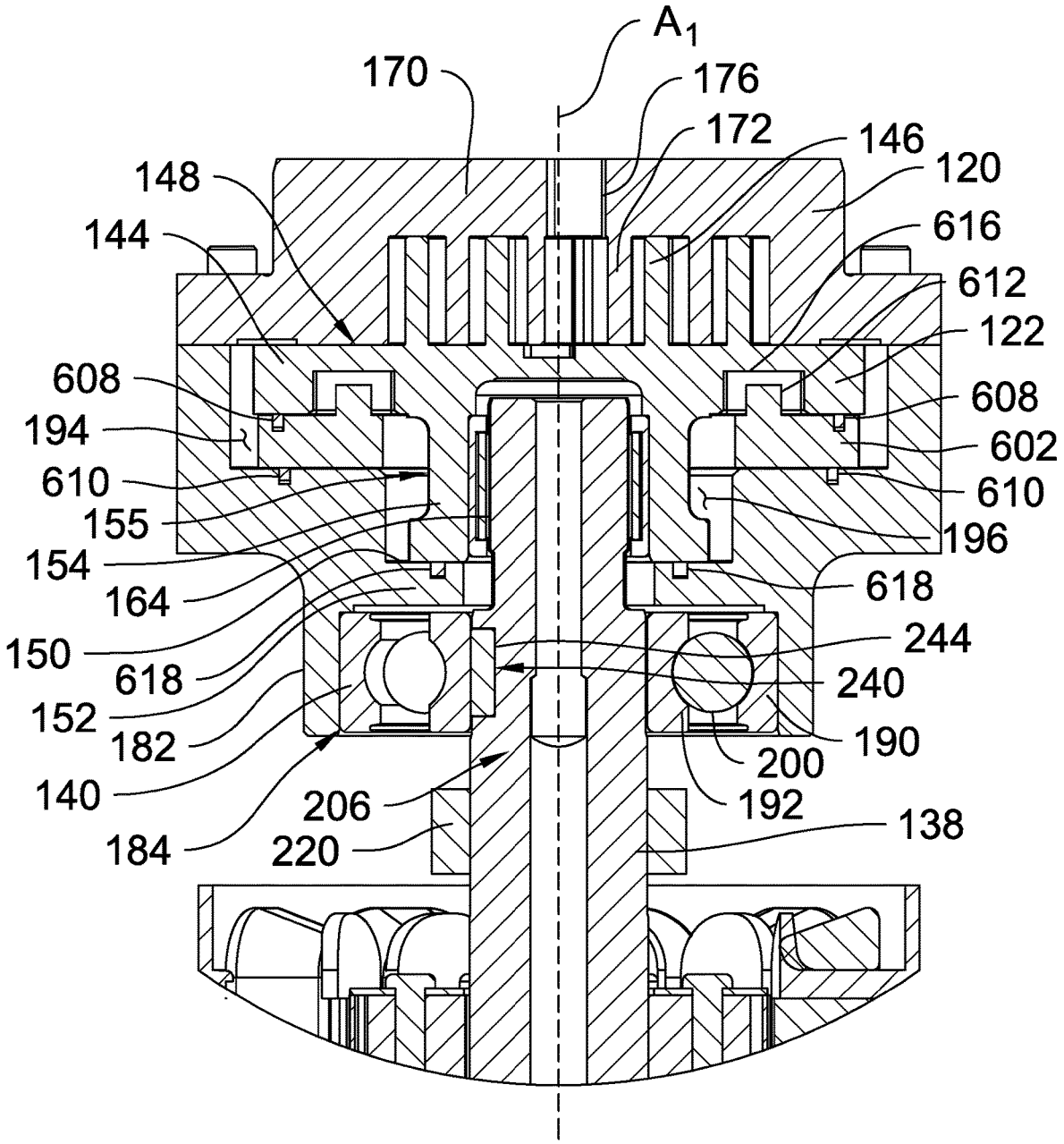
FIG. 25 is a detailed view of the compressor shown in FIG. 24 taken within detail 1, with an endcap and shell removed from the compressor.

Referring to FIGS. 24 and 25, the top protrusion 612 of the coupling 602 is positioned within the protrusion channel 616 of orbiting scroll 122 such that the top protrusion 612 is configured to translate relative to the protrusion channel 616 of the orbiting scroll 122. Similarly, the bottom protrusion 614 of the coupling 602 is positioned within the protrusion channel (not shown) of main bearing housing 180 such that the bottom protrusion 614 is configured to translate relative to the protrusion channel (not shown) of the main bearing housing 180. As depicted in FIGS. 26-28, the top protrusions 612 are oppositely spaced extending from the top surface 604 and the bottom protrusions 614 are oppositely spaced extending from the bottom surface 606. The top protrusions 612 may be spaced about 180 degrees from each other and the bottom protrusions 614 may be spaced about 180 degrees from each other. Thus, one of the top protrusion 612 or the bottom protrusion 614 may be circumferentially spaced every about 90 degrees around longitudinal axis A3 of coupling 602. However, it should be understood that more or less protrusions 612, 614 may be used and may be spaced differently, without departing from the spirit/scope of this disclosure. In operation, coupling 602 may translate relative to orbiting scroll 122 and main bearing housing 180 to ensure the orbiting scroll 122 and the main bearing housing 180 remain indirectly connected during movement. The motion of the orbiting scroll 122 is translational despite moving in two directions. For example, with the Z-axis being parallel to A1, the orbiting scroll 122 moves in the X and Y axis. The top protrusion 612 of the coupling 602 translates within the protrusion channel 616 of the orbiting scroll 122 to enable the coupling 602 to move along the X and Y axes. The bottom protrusion 614 of the coupling 602 translates within the protrusion channel (not shown) of the main bearing housing 180 to enable the coupling 602 to move along the X and Y axes.

As will be discussed in more detail below with respect to FIGS. 31-38, seals 608, 610 may be axially aligned with each other and circumferentially aligned such that the outer portion of each seal 608, 610 is aligned with the other 610, 608. In other instances, seals 608, 610 may be axially aligned but may not be circumferentially aligned. In yet another instance, seals 608, 610 may not be axially aligned. In another instance, seals 608, 610 may be aligned axially relative to longitudinal axis A3.

The compressor 100 may also include a hub seal 618 positioned in in contact with the cylindrical hub 154 of the orbiting scroll 122. The hub seal 618 is mounted with respect to the second side 152 of the main bearing housing 180. The hub seal 618 is mounted with respect to the second side 152 of the main bearing housing 180 such that the hub seal 618 is in direct or indirect contact with the cylindrical hub 154 of the orbiting scroll 122. The hub seal 618 may be positioned within a channel 618' such that a surface of the seal 618 is configured to contact the annular flat surface 150 of the cylindrical hub 154. The depth of the channel 618' may depend, in part, on the thickness of the hub seal 618. The amount that the hub seal 618 protrudes from the main bearing housing 180 in the direction of the cylindrical hub 154 may depend, in part, on at least one of the following, the thickness of the hub seal 618, the gap between the cylindrical hub 182 and the main bearing housing 180, the depth of the channel 618', and combinations thereof. Alternatively, the hub seal 618 may be positioned within the channel 618' and extending outwardly from the annular flat surface 150 of the cylindrical hub 154 in the direction of the second side 152 of the main bearing housing 180.

In operation, pressure produced by the series of moving fluid pockets created by the spiral wraps 146, 172 of the orbiting scroll 122 and non-orbiting scroll 120, is released into the port 198. The port 198 is in fluid communication with the intermediate pressure cavity 196, the outside pressure cavity 194, or the intermediate pressure cavity 196 and the outside pressure cavity 194. In some instances, a second port (not shown) may be in fluid communication with the outside cavity 194. The pressure within the intermediate pressure cavity 196 may be different than the pressure within the outside pressure cavity 194. Each cavity 194, 196 is sealed with two or more seals positioned in direct or indirect contact with the main bearing housing 180, the orbiting scroll 122, and/or the coupling 602. For example, compressed gas discharged into outside pressure cavity 194 may be sealed with the first seal 608 and the second seal 610. Gas discharged into intermediate pressure cavity 196 may be sealed with the first seal 608, the second seal 610, and the hub seal 618. Sealing of the pressure cavities 194, 196 prevents at least pressure loss which provides pressure to bias the scrolls against one another to reduce efficiency losses due to leakage between the scroll wraps and minimize the friction losses in the compression mechanism.

Figure 39:
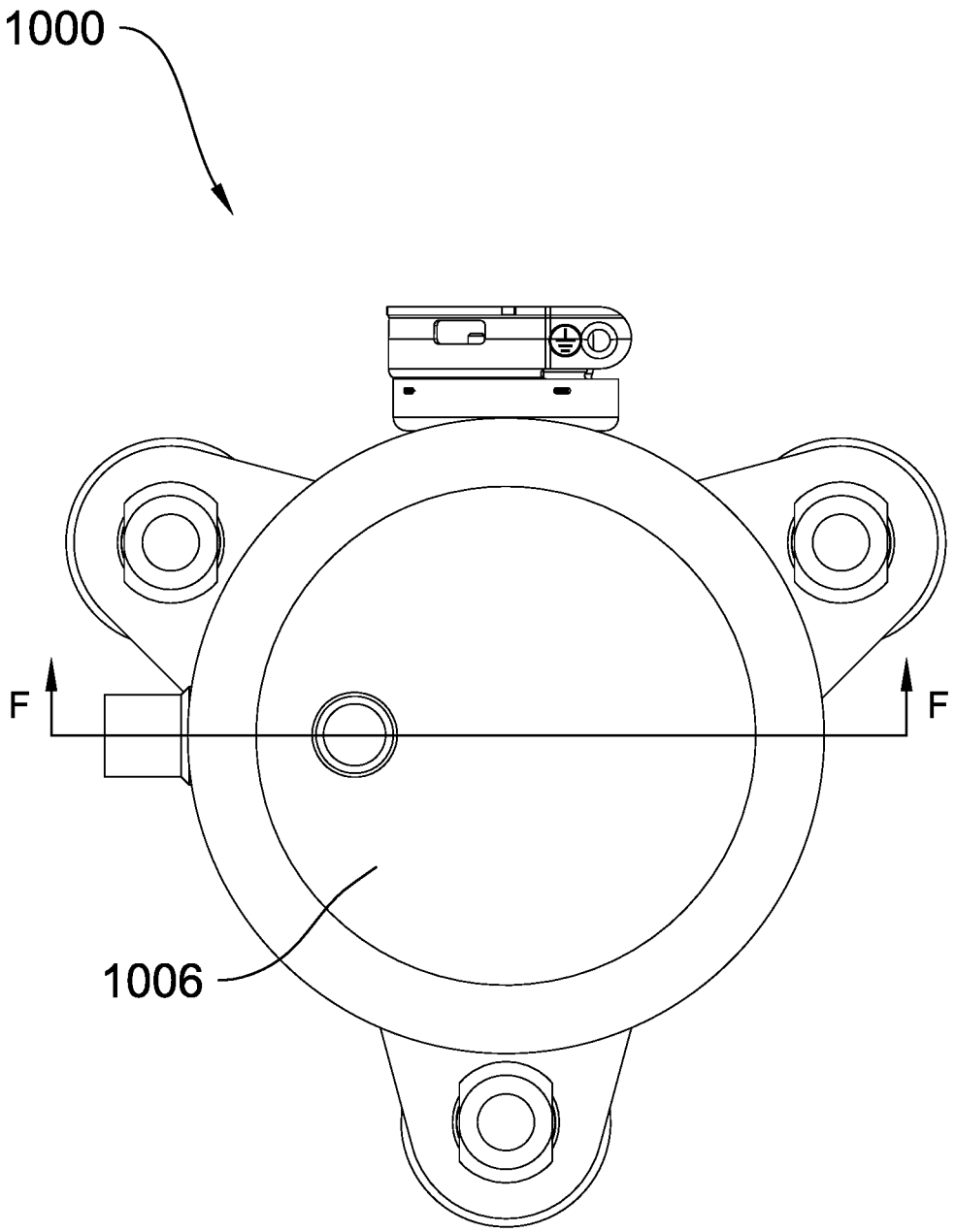
FIG. 39 is a top view of a compressor.
Figure 40:
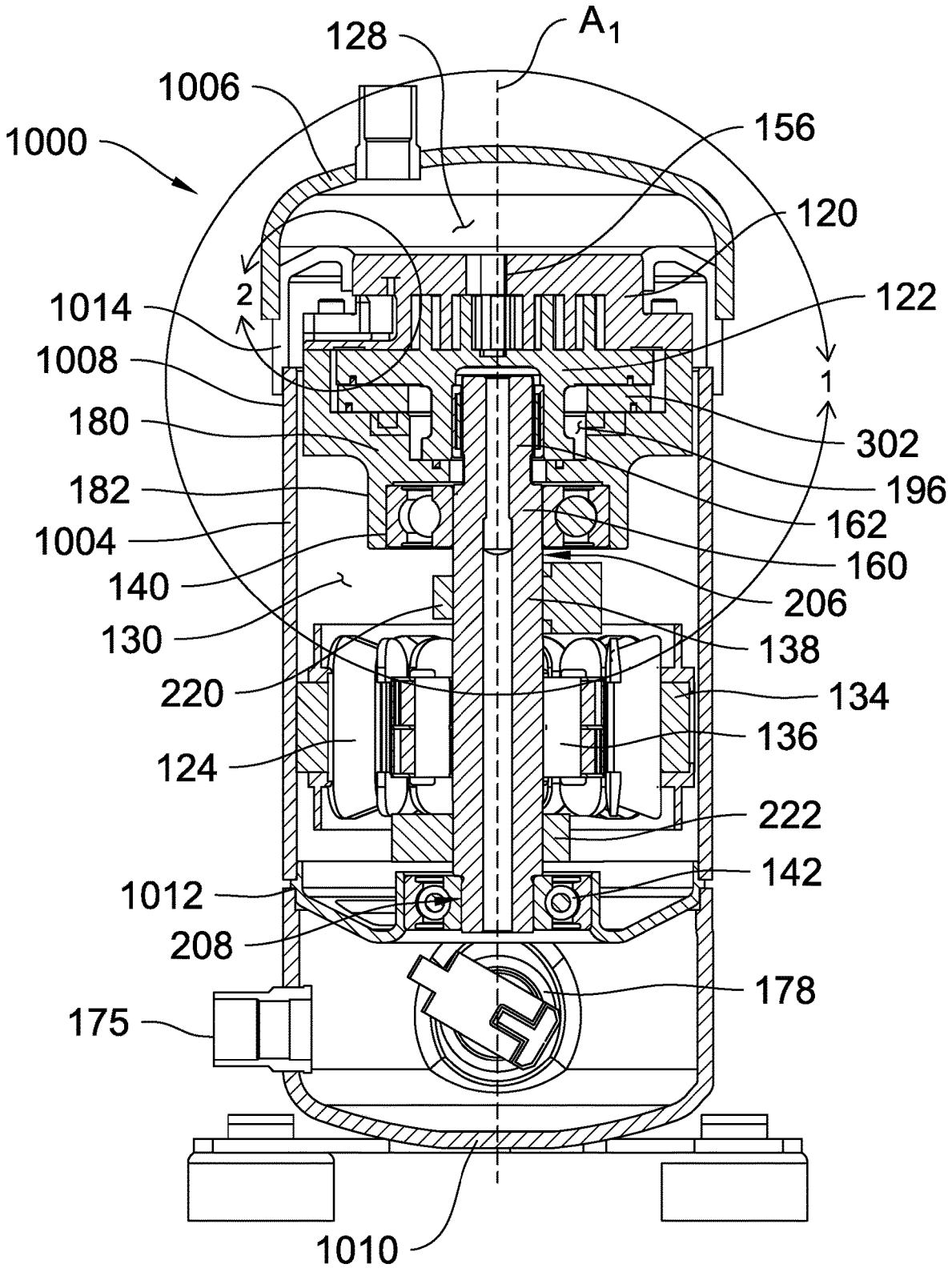
FIG. 40 is a cross-sectional view of the compressor shown in FIG. 39 taken along line F-F, illustrating the first seal configuration of the compressor.

Referring to FIGS. 39 and 40, a compressor, in this example a scroll compressor, is indicated generally at 1000. The compressor 1000 (e.g., a low-side compressor) includes a compressor housing 1002 forming at least one sealed cavity within which refrigerant compression is accomplished. The compressor housing 1002 includes a shell 1004, an end cap 1006 positioned at a first end 1008 of the shell 1004, and a base 1010 positioned at an opposing second end 1012 of the shell 1004. The scroll compressor 1000 may be a floating orbit design, a floating non-orbit design such as co-rotating, and related compressor designs. The scroll compressor 1000 includes a muffler plate 1014 positioned at the first end 1008. The muffler plate 1014 may separate high pressure from low pressure.

Figure 41:
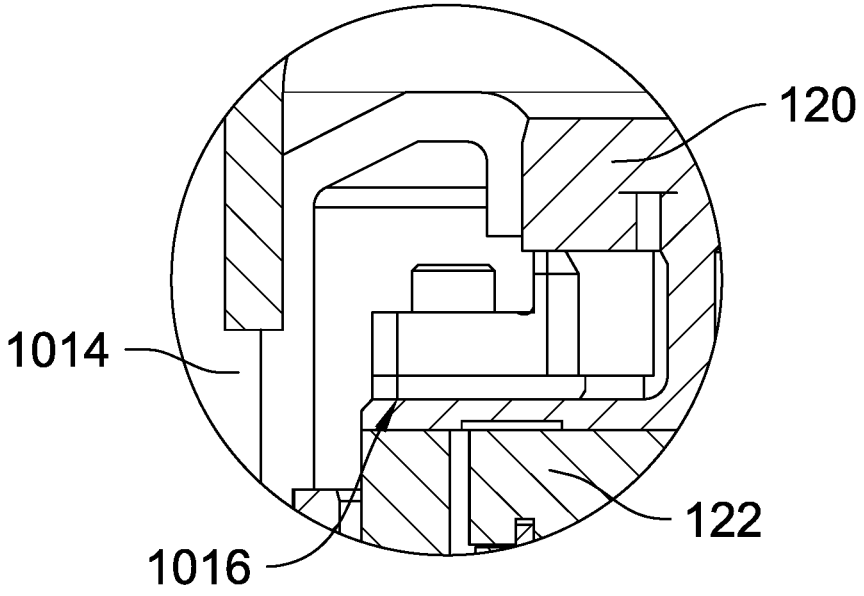
FIG. 41 is a detailed view of the compressor shown in FIG. 40 taken within detail 2.

Compressor 1000 includes features/components previously described with regard to compressor 100. Thus, like parts/features will be numbered the same throughout the various embodiments. The features described with respect to one embodiment may apply to the other embodiments unless expressly stated otherwise. For example, Detail 1 of the scroll compressor 1000 is similar to Detail 1 of the scroll compressor 100, as described in FIGS. 4, 11, 18, and 25, with the muffler plate 1014 also removed. Therefore, Oldham coupling 302 of the compressor 1000 may include any seal configuration as described herein. The compressor 1000 further includes a passage 1016 of the non-orbiting scroll 120 to deliver gas flow from the chamber 130 to the chamber 128 (see, e.g., FIG. 41).

Figure 31:
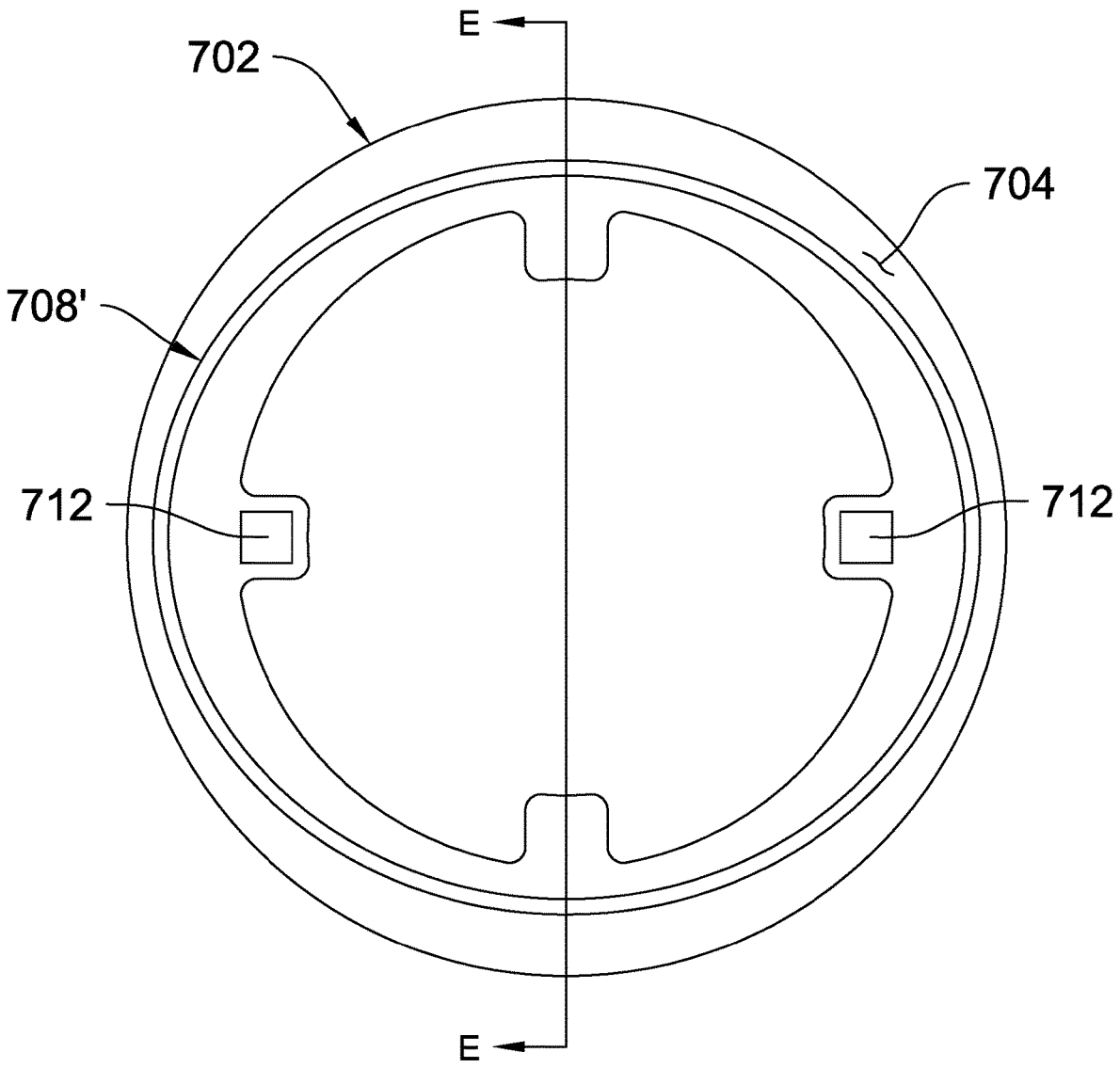
FIG. 31 is a top view of an Oldham coupling with an elliptical seal, illustrating a fifth seal configuration.
Figure 32:
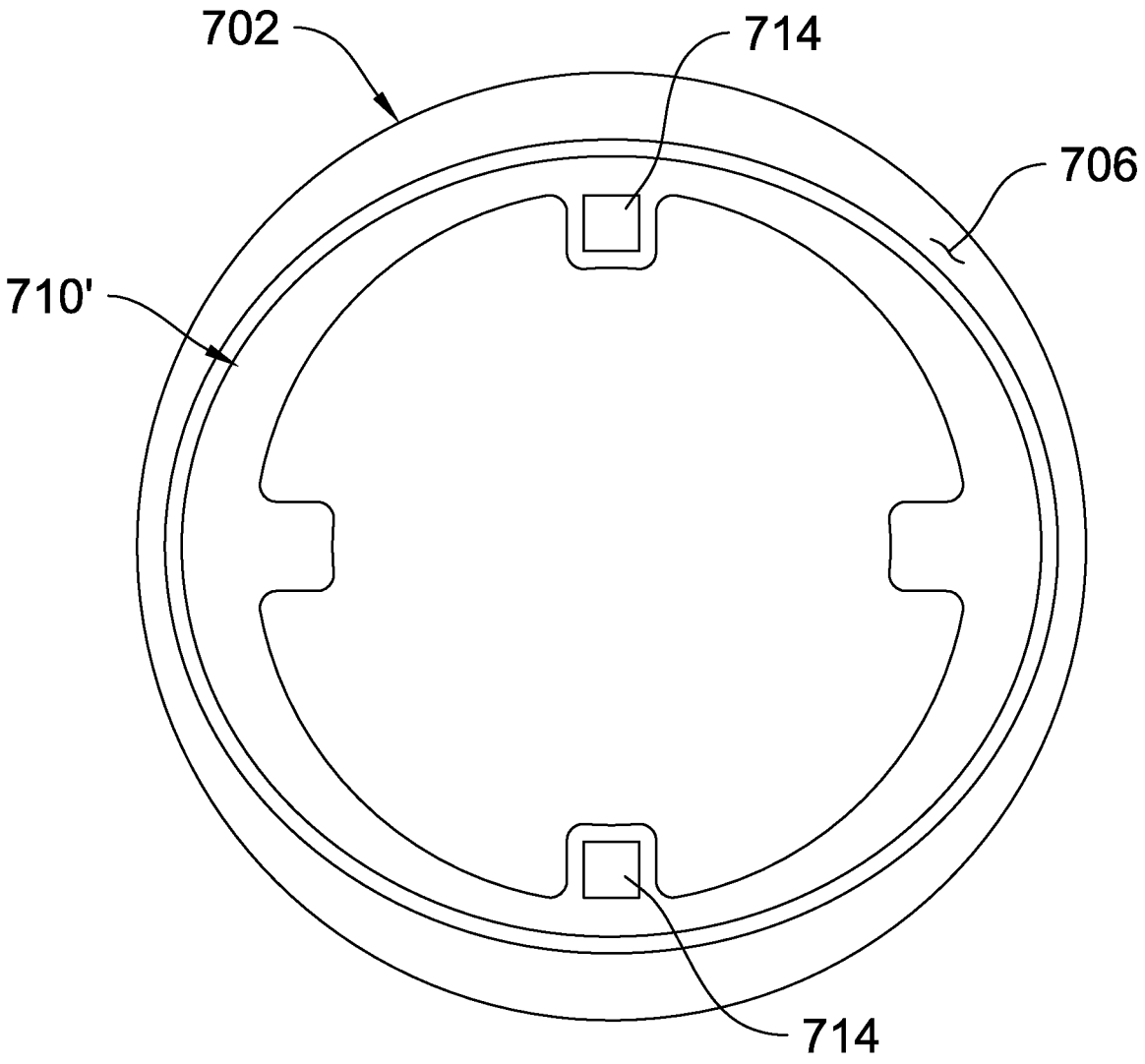
FIG. 32 is a bottom view of the Oldham coupling with the elliptical seal shown in FIG. 31, illustrating a fifth seal configuration.
Figure 33:
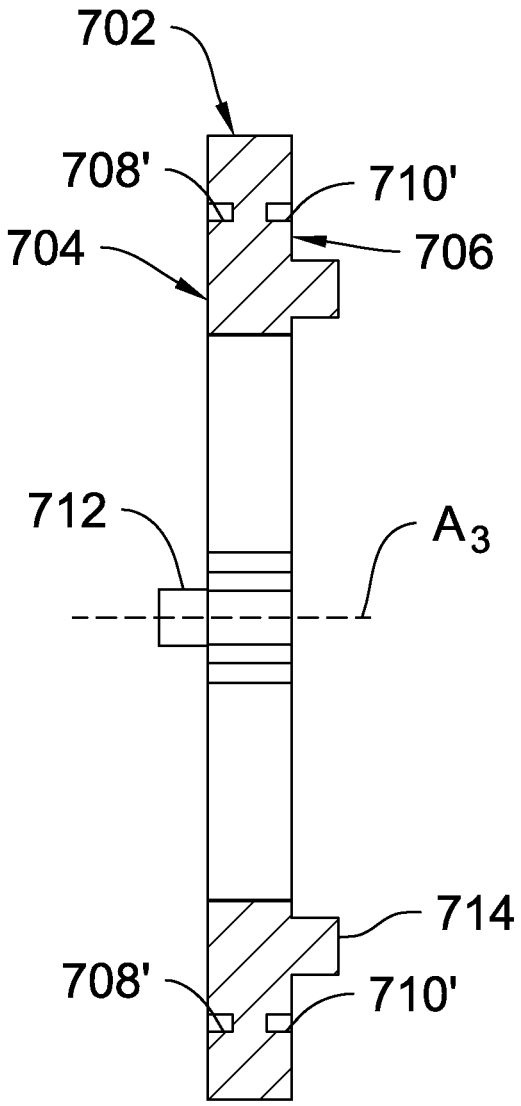
FIG. 33 is a cross-sectional view of the Oldham coupling shown in FIGS. 31 and 32 taken along line E-E, illustrating the position of the top elliptical seal relative to the bottom elliptical seal.

In yet another embodiment, as depicted in FIGS. 31-33, coupling 702 defines a top surface 704, a bottom surface 706, and a longitudinal axis A3 extending therebetween. Coupling 702 may be positioned within compressor 100, as described throughout this disclosure (e.g., embodiment 2 depicted in FIGS. 10-16). Coupling 702 includes a first channel 708', which is positioned on the top surface 704, and a second channel 710', which is positioned on the bottom surface 706. The first channel 708' is configured to at least partially receive a first seal (not shown) and the second channel 710' is configured to at least partially receive a second seal (not shown). The channels 708', 710' may be positioned axially to longitudinal axis A3 of coupling 702. Additionally, channels 708', 710' are axially aligned with each other and circumferentially aligned such that the outer portion of each channel 708', 710' is aligned with the other 710', 708'. As depicted, the channels 708', 710' are elliptical in shape. It should be understood, however, that in other embodiments, one of the channels may be circular in shape while the other is elliptical in shape.

Coupling 702 includes a top protrusion 712 and a bottom protrusion 714, the top and bottom protrusions 712, 714 are configured to engage with the orbiting scroll 122 and/or the main bearing housing 180, either directly or indirectly. As depicted, the coupling 702 includes at least two top protrusions 712 and at least two bottom protrusions 714. The top protrusion 712 extends outwardly from the top surface 704 of the coupling 702 in a direction opposite the bottom surface 706. The top protrusion 712 is configured to movably engage with a protrusion channel of orbiting scroll 122. The bottom protrusion 714 extends outwardly from the bottom surface 706 of the coupling 702 in a direction opposite the top surface 704. The bottom protrusion 714 is configured to movably engage with a protrusion channel (not shown) of the main bearing housing 180. The top and bottom protrusions 712, 714 may extend perpendicularly from top surface 704 and bottom surface 706, respectively.

As depicted, the top protrusions 712 are oppositely spaced extending from the top surface 704 and the bottom protrusions 714 are oppositely spaced extending from the bottom surface 706. The top protrusions 712 may be spaced about 180 degrees from each other and the bottom protrusions 714 may be spaced about 180 degrees from each other. Thus, one of the top protrusion 712 or the bottom protrusion 714 may be radially spaced every about 90 degrees around longitudinal axis A3 of coupling 702. However, it should be understood that more or less protrusions 712, 714 may be used and may be spaced differently, without departing from the spirit/scope of this disclosure. In operation, coupling 702 may translate relative to orbiting scroll 122 and main bearing housing 180 to ensure the orbiting scroll 122 and the main bearing housing 180 remain indirectly connected during rotation.

Figure 34:
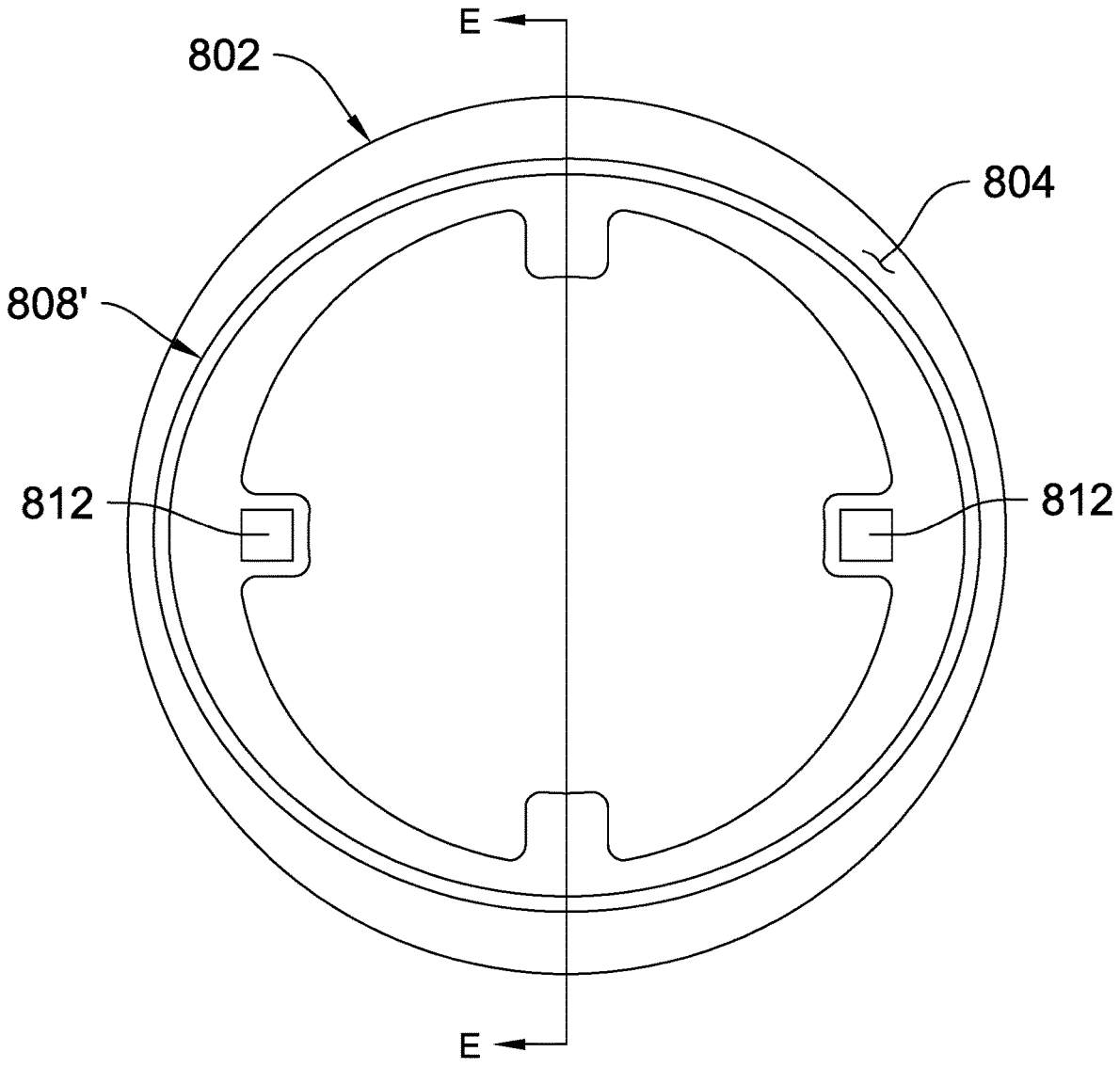
FIG. 34 is a top view of an Oldham coupling with an elliptical seal, illustrating a sixth seal configuration.
Figure 35:
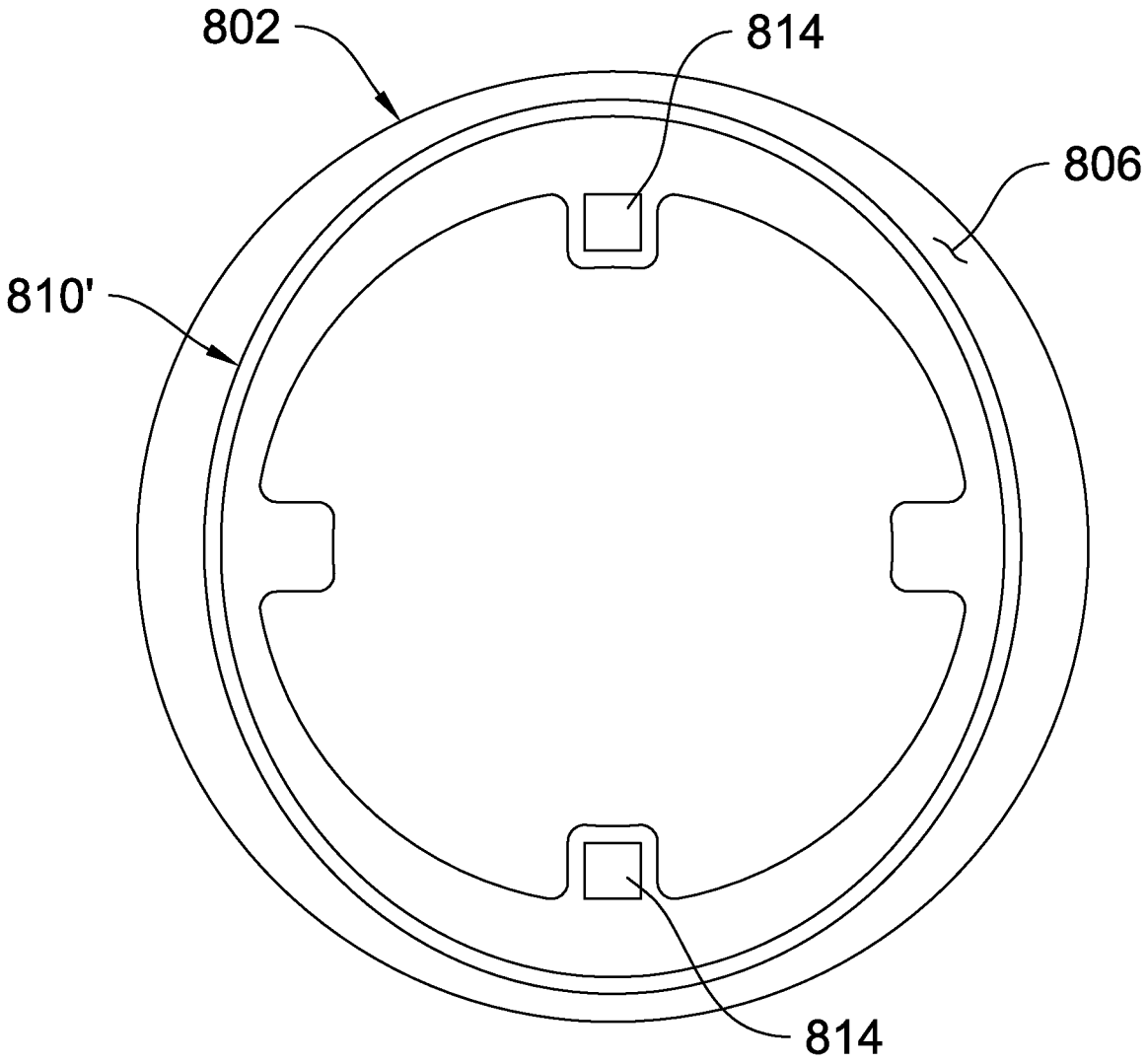
FIG. 35 is a bottom view of the Oldham coupling with the elliptical seal shown in FIG. 34, illustrating a sixth seal configuration.
Figure 36:
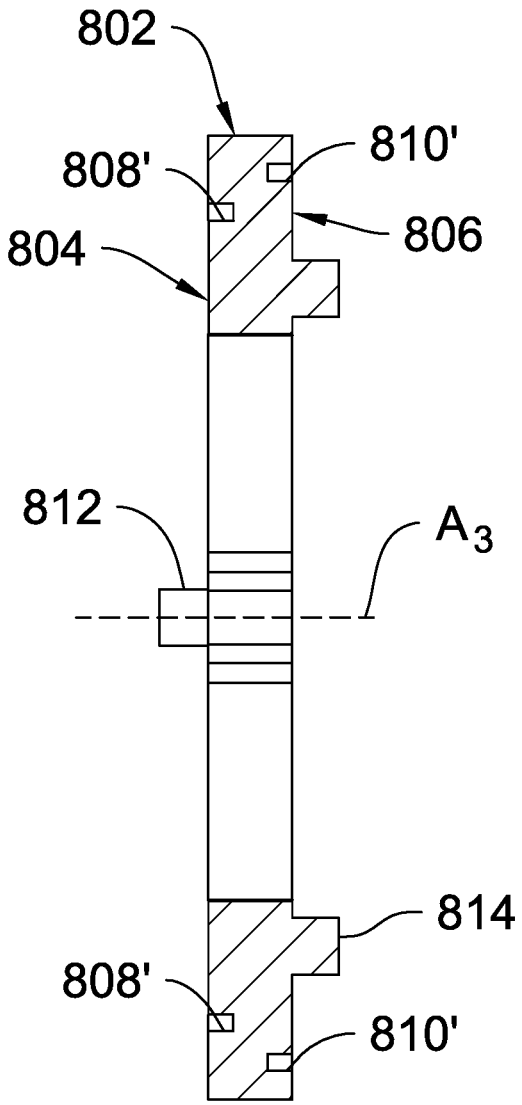
FIG. 36 is a cross-sectional view of the Oldham coupling shown in FIGS. 31 and 32 taken along line E-E, illustrating the position of the top elliptical seal relative to the bottom elliptical seal.

In yet another embodiment, as depicted in FIGS. 34-36, coupling 802 defines a top surface 804, a bottom surface 806, and a longitudinal axis A3 extending therebetween. Coupling 802 may be positioned within compressor 100, 1000, as described throughout this disclosure (e.g., embodiment 2 depicted in FIGS. 10-16). Coupling 802 includes a first channel 808', which is positioned on the top surface 804, and a second channel 810', which is positioned on the bottom surface 806. The first channel 808' is configured to at least partially receive a first seal (not shown) and the second channel 810' is configured to at least partially receive a second seal (not shown). The channels 808', 810' may be positioned axially to longitudinal axis A3 of coupling 802. Channels 808', 810' are axially aligned with each other but not circumferentially aligned such that the outer portion of each channel 808', 810' is not aligned with the other 810', 808'. As depicted, the channels 808', 810' are elliptical in shape, and, in a non-limiting example, each channel 808', 810' is rotated radially about 90 degrees so that the wider portion of the first channel 808' is oppositely positioned from the narrower portion of the second channel 810'. It should be understood, however, that the channels 808', 810' may be rotated radially at any desired degree so as to provide optimal gas clamping force. In some embodiments, one of the channels may be circular in shape while the other is elliptical in shape.

Coupling 802 includes a top protrusion 812 and a bottom protrusion 814, the top and bottom protrusions 812, 814 are configured to engage with the orbiting scroll 122 and/or the main bearing housing 180, either directly or indirectly. As depicted, the coupling 802 includes at least two top protrusions 812 and at least two bottom protrusions 814. The top protrusion 812 extends outwardly from the top surface 804 of the coupling 802 in a direction opposite the bottom surface 806. The top protrusion 812 is configured to movably engage with a protrusion channel of orbiting scroll 122. The bottom protrusion 814 extends outwardly from the bottom surface 806 of the coupling 802 in a direction opposite the top surface 804. The bottom protrusion 814 is configured to movably engage with a protrusion channel (not shown) of the main bearing housing 180. The top and bottom protrusions 812, 814 may extend perpendicularly from top surface 804 and bottom surface 806, respectively.

As depicted, the top protrusions 812 are oppositely spaced extending from the top surface 804 and the bottom protrusions 814 are oppositely spaced extending from the bottom surface 806. The top protrusions 812 may be spaced about 180 degrees from each other and the bottom protrusions 814 may be spaced about 180 degrees from each other. Thus, one of the top protrusion 812 or the bottom protrusion 814 may be radially spaced every about 90 degrees around longitudinal axis A3 of coupling 802. However, it should be understood that more or less protrusions 812, 814 may be used and may be spaced differently, without departing from the spirit/scope of this disclosure. In operation, coupling 802 may translate relative to orbiting scroll 122 and main bearing housing 180 to ensure the orbiting scroll 122 and the main bearing housing 180 remain indirectly connected during rotation.

Figure 37:
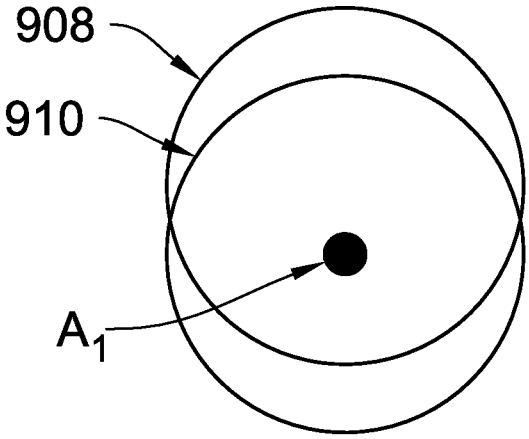
FIG. 37 is a top view schematic of a circular first seal positioned relative to a circular second seal as it relates to any of the proceeding seal configurations for the compressor shown in FIGS. 1 and 2.
Figure 38:
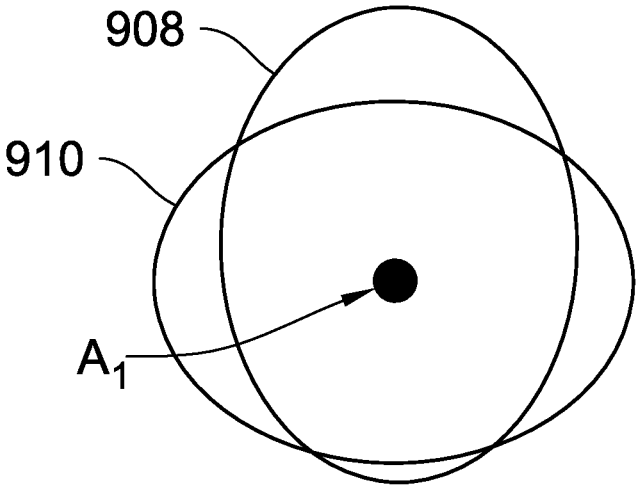
FIG. 38 is a top view schematic of an elliptical first seal positioned relative to an elliptical second seal as it relates to any of the proceeding seal configurations for the compressor shown in FIGS. 1 and 2.

The one or more seals may have a shape and/or a cross-sectional shape that is circular, elliptical, quadrilateral, triangular, and combinations thereof. The one or more seals may be centered relative to the center of the orbiting scroll 122. By centering the one or more seals, friction losses by the orbiting scroll 122 may be minimized. Referring to FIG. 37, seal 908, 910 has a circular shape as defined by the circumference of seal 908, 910. Seal 908, 910 may be centered relative to the center of the orbiting scroll 122. Referring to FIG. 38, seal 908, 910 has an elliptical shape as defined by the circumference of seal 908, 910. Seal 908, 910 may be centered relative to the center of the orbiting scroll 122. As illustrated in FIGS. 37 and 38, seals 908, 910 may not be coaxial relative to the other seal 910, 908, but combined seals 908, 910 may be centered relative to the longitudinal axis A1 of orbiting scroll 122.

Although the seals described herein are labeled as "first" and "second" seals, the seals may be interchangeable, unless indicated or stated otherwise, without departing from the spirit/scope of this disclosure.

Embodiments of the systems and methods of the present disclosure achieve superior results as compared with prior systems and methods. For example, combining the Oldham coupling ring and the outer seal minimizes the compression mechanism diameter and optimizes the gas clamping force.

This application relates to U.S. patent application Ser. No. 17/935,422, filed on Sep. 26, 2022, the application is hereby incorporated by reference in its entirety.

When introducing elements of the present disclosure or the embodiment(s) thereof, the articles "a", "an", "the," and "said" are intended to mean that there are one or more of the elements. The terms "comprising," "including," "containing," and "having" are intended to be inclusive and mean that there may be additional elements other than the listed elements. The use of terms indicating a particular orientation (e.g., "top," "bottom," "side," etc.) is for convenience of description and does not require any particular orientation of the item described.

As various changes could be made in the above constructions and methods without departing from the scope of the disclosure, it is intended that all matter contained in the above description and shown in the accompanying drawing(s) shall be interpreted as illustrative and not in a limiting sense.

The invention claimed is:

1. A compressor comprising:

a shell;

a main bearing housing positioned within the shell, the main bearing housing comprising:

a first cavity; and a primary bearing positioned within a second cavity positioned opposite the first cavity;

a scroll assembly positioned within the shell and positioned relative to the first cavity of the main bearing housing, the scroll assembly comprising:

a non-orbiting scroll including a non-orbiting spiral wrap;

an orbiting scroll including an orbiting spiral wrap and a cylindrical hub oppositely positioned from the orbiting spiral wrap, the cylindrical hub defines a first opening including a drive bearing positioned therein; and a coupling positioned between the orbiting scroll and a fixed component and movable relative to at least one of the orbiting scroll and the fixed component, wherein the fixed component is fixed in both an axial and a radial direction;

a drive shaft axially positioned relative to the first cavity and the second cavity of the main bearing housing, the drive shaft including a driveshaft body and an eccentric body, the eccentric body positioned within the first opening and drivingly engaged with the drive bearing of the orbiting scroll; and a first seal sealingly engaged with the orbiting scroll and the coupling, a second seal sealingly engaged with the coupling and the main bearing housing, and a third seal sealingly engaged with the cylindrical hub and the main bearing housing, wherein the main bearing housing and the orbiting scroll define a pressure cavity.

2. The compressor according to claim 1, wherein the first seal is positioned relative to the orbiting scroll and configured to contact the coupling, and the second seal is positioned relative to the coupling and contacts the main bearing housing, either directly or indirectly.

3. The compressor according to claim 1, wherein the first seal is positioned relative to the coupling and configured to contact the orbiting scroll, and the second seal is positioned relative to the coupling and contacts the main bearing housing, either directly or indirectly.

4. The compressor according to claim 1, wherein the first seal is positioned relative to the orbiting scroll and configured to contact the coupling, and the second seal is positioned relative to the main bearing housing and contacts the coupling, either directly or indirectly.

5. The compressor according to claim 1, wherein the first seal is positioned relative to the coupling and configured to contact the orbiting scroll, and the second seal is positioned relative to the main bearing housing and contacts the coupling, either directly or indirectly.

6. The compressor according to claim 1, wherein the third seal is positioned relative to the main bearing housing and contacts the orbiting scroll, either directly or indirectly.

7. The compressor according to claim 1, wherein the third seal is positioned relative to the orbiting scroll and contacts the main bearing housing, either directly or indirectly.

8. The compressor according to claim 1, wherein the fixed component includes the non-orbiting scroll or the main bearing housing.

9. A scroll assembly mounted in a main bearing housing, the scroll assembly comprising:

a non-orbiting scroll including a non-orbiting spiral wrap;

an orbiting scroll including an orbiting spiral wrap and a cylindrical hub oppositely positioned from the orbiting spiral wrap;

a coupling positioned between the orbiting scroll and a fixed component and movable relative to at least one of the orbiting scroll and the fixed component, wherein the fixed component is fixed in both an axial and a radial direction; and a first seal sealingly engaged with the orbiting scroll and the coupling, a second seal sealingly engaged with the coupling and the main bearing housing, and a third seal sealingly engaged with the cylindrical hub and the main bearing housing, wherein at least the main bearing housing and the orbiting scroll define a pressure cavity.

10. The scroll assembly according to claim 9, wherein the first seal is positioned relative to the orbiting scroll and configured to contact the coupling, and the second seal is positioned relative to the coupling and contacts the main bearing housing, either directly or indirectly.

11. The scroll assembly according to claim 9, wherein the first seal is positioned relative to the coupling and configured to contact the orbiting scroll, and the second seal is positioned relative to the coupling and contacts the main bearing housing, either directly or indirectly.

12. The scroll assembly according to claim 9, wherein the first seal is positioned relative to the orbiting scroll and configured to contact the coupling, and the second seal is positioned relative to the main bearing housing and contacts the coupling, either directly or indirectly.

13. The scroll assembly according to claim 9, wherein the first seal is positioned relative to the coupling and configured to contact the orbiting scroll, and the second seal is positioned relative to the main bearing housing and contacts the coupling, either directly or indirectly.

14. The scroll assembly according to claim 9, wherein the third seal is positioned relative to the main bearing housing and contacts the orbiting scroll, either directly or indirectly.

15. The scroll assembly according to claim 9, wherein the third seal is positioned relative to the orbiting scroll and contacts the main bearing housing, either directly or indirectly.

16. The scroll assembly according to claim 9, wherein at least one of the first seal, the second seal, and the third seal define a circular shape.

17. The scroll assembly according to claim 9, wherein at least one of the first seal, the second seal, and the third seal define an elliptical shape.

18. A compressor comprising:

a shell;

a main bearing housing positioned within the shell, the main bearing housing comprising:

a first cavity; and a primary bearing positioned within a second cavity positioned opposite the first cavity;

a scroll assembly positioned within the shell and positioned relative to the first cavity of the main bearing housing, the scroll assembly comprising:

a non-orbiting scroll including a non-orbiting spiral wrap;

an orbiting scroll including an orbiting spiral wrap and a cylindrical hub oppositely positioned from the orbiting spiral wrap, the cylindrical hub defines a first opening including a drive bearing positioned therein; and a coupling positioned between the orbiting scroll and a fixed component and movable relative to at least one of the orbiting scroll and the fixed component, wherein the fixed component is fixed in both an axial and a radial direction;

a drive shaft axially positioned relative to the first cavity and the second cavity of the main bearing housing, the drive shaft including a driveshaft body and an eccentric body, the eccentric body positioned within the first opening and drivingly engaged with the drive bearing of the orbiting scroll; and a plurality of seals positioned relative to the scroll assembly and the main bearing housing, wherein the plurality of seals isolate a pressure cavity defined by at least the orbiting scroll and the main bearing housing, the plurality of seals including a first seal sealingly engaged with the orbiting scroll and the coupling.

19. The compressor according to claim 18, wherein the plurality of seals comprises the first seal positioned relative to the coupling and the orbiting scroll and a second seal positioned relative to the coupling and the main bearing housing.

20. The compressor according to claim 19, wherein the plurality of seals further comprises a third seal positioned relative to the orbiting scroll and the main bearing housing.

* * * * *